US009758748B2

(12) United States Patent
Neal

(10) Patent No.: US 9,758,748 B2
(45) Date of Patent: Sep. 12, 2017

(54) ARTICLES OF MANUFACTURE COMPRISING HYDROCARBON FLUIDS AND WATER-SOLUBLE POLYMER PARTICLES AND PROCESSES FOR MAKING SAME

(71) Applicant: The Procter & Gamble Company, Cincinnati, OH (US)

(72) Inventor: Charles William Neal, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 37 days.

(21) Appl. No.: 14/220,161

(22) Filed: Mar. 20, 2014

(65) Prior Publication Data

US 2014/0287977 A1 Sep. 25, 2014

Related U.S. Application Data

(63) Continuation of application No. 61/803,614, filed on Mar. 20, 2013.

(51) Int. Cl.

| | |
|---|---|
| ***C11D 7/24*** | (2006.01) |
| ***C11D 3/37*** | (2006.01) |
| ***D21H 27/00*** | (2006.01) |
| ***D21H 17/04*** | (2006.01) |
| ***D21H 17/37*** | (2006.01) |

(52) U.S. Cl.

CPC ..... *C11D 3/3757* (2013.01); *D21H 17/04* (2013.01); *D21H 17/37* (2013.01); *D21H 27/002* (2013.01)

(58) Field of Classification Search

CPC ..... C11D 7/24; C11D 7/5004; C11D 7/509; C11D 9/225; C11D 9/24; C11D 11/0023; C11D 17/041; C11D 17/049

See application file for complete search history.

(56) References Cited

U.S. PATENT DOCUMENTS

| | | | | |
|---|---|---|---|---|
| 8,986,663 | B2 * | 3/2015 | Jordan et al. | 424/60 |
| 2002/0050016 | A1 * | 5/2002 | Willman et al. | 15/104.002 |
| 2004/0030312 | A1 * | 2/2004 | Kainth et al. | 604/368 |
| 2004/0092417 | A1 * | 5/2004 | Moodycliffe et al. | 510/296 |
| 2004/0166079 | A1 * | 8/2004 | Garcia | 424/70.14 |
| 2006/0116524 | A1 * | 6/2006 | Bruening | A61K 8/0208 554/166 |
| 2006/0222675 | A1 * | 10/2006 | Sabnis | A61F 13/42 424/405 |
| 2009/0131340 | A1 * | 5/2009 | Lanzendorfer et al. | 514/27 |
| 2010/0021696 | A1 * | 1/2010 | Hill | B31F 1/07 428/187 |
| 2011/0033413 | A1 * | 2/2011 | Kwetkat et al. | 424/78.03 |
| 2012/0055643 | A1 | 3/2012 | Neal et al. | |
| 2012/0115808 | A1 * | 5/2012 | Della Valle et al. | 514/54 |
| 2012/0207812 | A1 * | 8/2012 | Strodtholz | A61K 8/0208 424/443 |
| 2013/0255898 | A1 | 10/2013 | Redd et al. | |
| 2013/0344022 | A1 * | 12/2013 | Anderson et al. | 424/73 |
| 2014/0366295 | A1 * | 12/2014 | Neal et al. | 15/104.93 |

OTHER PUBLICATIONS

International Search Report mailed Jun. 18, 2014.

* cited by examiner

*Primary Examiner* — Charles Boyer
(74) *Attorney, Agent, or Firm* — C. Brant Cook

(57) ABSTRACT

Articles of manufacture, such as paper towels, that contain polymer particles, for example water-soluble polymer particles, for example water-soluble soil adsorbing polymer particles and processes for making same are provided.

16 Claims, 1 Drawing Sheet

| | | | |
|---|---|---|---|
| Side 3 - Wet Side to Side | Side 1 - Wet Side to Side | Side 5 - Wet Side to Side | Side 7 - Wet Side to Side |
| Side 4 - Dry Up and Down | Side 2 - Dry Up and Down | Side 6 - Dry Up and Down | Side 8 - Dry Up and Down |

FIG. 1

| | | |
|---|---|---|
| 1 | 2 | 3 |
| 4 | 5 | 6 |
| 7 | 8 | 9 |

FIG. 2

ARTICLES OF MANUFACTURE COMPRISING HYDROCARBON FLUIDS AND WATER-SOLUBLE POLYMER PARTICLES AND PROCESSES FOR MAKING SAME

FIELD OF THE INVENTION

The present invention relates to articles of manufacture, such as paper towels, that comprise polymer particles, for example water-soluble polymer particles, for example water-soluble soil adsorbing polymer particles, more particularly to articles of manufacture, such as paper towels, comprising water-soluble polymer particles that have been delivered to the articles of manufacture via a dewatered emulsion comprising a continuous phase comprising a hydrocarbon fluid and a dispersed phase (discontinuous phase) comprising water-soluble polymer particles, and processes for making same.

BACKGROUND OF THE INVENTION

Articles of manufacture, such as paper towels, comprising water-soluble polymer particles, such as water-soluble soil adsorbing polymer particles, are known in the art. Such water-soluble soil adsorbing polymer particles have been delivered to such articles of manufacture in the form of inverse emulsions (where the water-soluble polymer particles are present in a dispersed aqueous phase (discontinuous aqueous phase) within a continuous hydrocarbon fluid phase) and/or dewatered inverse emulsions ("dewatered emulsions") (where the water-soluble polymer particles are present in a dispersed non-aqueous phase (discontinuous non-aqueous phase) within a continuous hydrocarbon fluid phase wherein the hydrocarbon fluid phase).

The articles of manufacture comprising the inverse emulsions, such as Hyperfloc® NE823F, commercially available from HyChem, Inc., a fully-owned subsidiary of SNF, Inc., are undesirable for use on articles of manufacture, such as paper towels, due to excessive flocculation of the inverse emulsions and/or components thereof, which may cause process equipment failures, such as extruder head and/or spray nozzle plugging, and they exhibit a high VOC content, which is greater than about 20% by weight of the neat emulsion.

The known articles of manufacture comprising dewatered emulsions, such as Hyperfloc® ND823, AD589, and CD864, also commercially available from HyChem, exhibit significantly improved shear stability compared to the inverse emulsions, such as NE823F, which results in the elimination and/or dramatic reduction of process equipment failures, such as the elimination and/or reduction of extruder head and/or spray nozzle plugging. However, such dewatered emulsions contain a non-aqueous continuous phase, such as an oil or "solvent", for example LPA 210, which is commercially available from Sasol, that exhibits a VOC content of greater than 60%, for example greater than 70%, as measured according to the VOC Test Method. As a result, even though these dewatered emulsions are known to be useful in water treatment processes, they are not optimal for use on articles of manufacture, such as paper towels. One negative of using such dewatered emulsions on articles of manufacture, such as paper towels, is the fugitive volatile organic compounds (VOCs) that may emit from the high "VOC content" about 10% by weight of the neat dewatered emulsions during production of the articles of manufacture and/or use of the articles of manufacture.

Accordingly, even though the known dewatered emulsions exhibit lower VOC content than their associated inverse emulsions, one problem faced by formulators of articles of manufacture is how to make an article of manufacture comprising water-soluble polymer particles, for example water-soluble soil adsorbing polymer particles, such that the process of making the article of manufacture and/or the article of manufacture itself does not contain a hydrocarbon fluid that exhibits a high VOC content of greater than 60% and/or greater than 70% and/or a dewatered emulsion that exhibits a high VOC content of greater than 6% and/or an inverse emulsion of greater than 20% as measured according to the VOC Test Method described herein. VOCs associated with these articles of manufacture are referred to as fugitive VOCs as measured by U.S. Environmental Protection Agency Method 24. To permit release of these high levels of VOCs requires extensive environmental measures including timely and costly major VOC permits and/or costly equipment and systems to manage the VOCs.

Accordingly, there is a need for an article of manufacture, such as a paper towel, that comprises water-soluble polymer particles, wherein the articles of manufacture and/or the process of making such articles of manufacture contain a hydrocarbon fluid that exhibits a VOC content of less than 60% and/or a dewatered emulsion that exhibits a high VOC content of greater than 6% and/or an inverse emulsion of greater than 20% as measured according to the VOC Test Method described herein, and a method for making such articles of manufacture hat overcomes the negatives described above.

SUMMARY OF THE INVENTION

The present invention fulfills the needs described above by providing articles of manufacture that comprise water-soluble polymer particles and a hydrocarbon fluid, wherein the hydrocarbon fluid exhibits a VOC content of less than 60% as measured according to the VOC Test Method described herein.

One solution to the high VOC problem identified above is to provide an article of manufacture comprising water-soluble polymer particles and a hydrocarbon fluid that exhibits a VOC content of less than 60% as measured according to the VOC Test Method described herein. One way to make such articles of manufacture is to contact (for example apply) a dewatered emulsion comprising a non-aqueous continuous phase containing a hydrocarbon fluid that exhibits a VOC content of less than 60% as measured according to the VOC Test Method described herein and a dispersed phase (discontinuous phase) comprising water-soluble polymer particles, for example soil adsorbing polymer particles.

Even though the articles of manufacture of the present invention contain a dewatered emulsion that exhibits a low VOC content (less than 6% and/or less than 5.5% as measured according to the VOC Test Method described herein) and/or a hydrocarbon fluid that exhibits a low VOC content (less than 60% and/or less than 50% and/or less than 40% and/or less than 30% and/or less than 20% and/or less than 10% and/or less than 5% and/or less than 1% as measured according to the VOC Test Method described herein), it was unexpectedly found that such articles of manufacture when exposed to Accelerated and/or Stress Aging Procedures described herein exhibit soil adsorption performance and/or mirror cleaning performance values less than the article of manufacture's initial average soil adsorption value as measured by the Soil Adsorption Test Method described herein and/or its initial average mirror cleaning value as measured according to the Mirror Cleaning Test Method described herein. One solution to the loss of the article of manufacture's initial average soil adsorption value and/or its initial mirror cleaning value is to provide the articles of manufacture and/or the dewatered emulsions that deliver the water-soluble soil adsorbing polymer particles to the articles of manufacture with greater levels of inverting surfactants and/or emulsifying surfactants and/or use a charged soil adsorbing polymer, such as a soil adsorbing polymer that exhibits a net negative charge as measured according to the Charge Density Test Method described herein, for example an anionic soil adsorbing polymer; and/or use a soil adsorbing polymer that exhibits a lower molecular weight (6 or less) as measured according to the UL Viscosity Test Method described herein.

In one example of the present invention, an article of manufacture comprising a plurality of water-soluble polymer particles and a hydrocarbon fluid, wherein the hydrocarbon fluid exhibits a VOC content of less than 60% as measured according to the VOC Test Method described herein is provided.

In another example of the present invention, an article of manufacture comprising a plurality of water-soluble polymer particles and a hydrocarbon fluid, wherein the hydrocarbon fluid exhibits a VOC content of less than 60% as measured according to the VOC Test Method described herein, and wherein the article of manufacture exhibits an Average Soil Adsorption Value of greater than 90 and/or greater than 110 and/or greater than 120 and/or greater than 150 and/or greater than 175 and/or greater than 200 mg soil/g article of manufacture as measured according to the Soil Adsorption Test Method described herein, is provided.

In still another example of the present invention, an article of manufacture comprising a plurality of water-soluble polymer particles and a hydrocarbon fluid, wherein the hydrocarbon fluid exhibits a VOC content of less than 60% as measured according to the VOC Test Method described herein, and wherein the article of manufacture exhibits an Average Mirror Densitometer Value of greater than −0.46 and/or greater than −0.30 and/or greater than −0.20 and/or greater than −0.15 as measured according to the Mirror Cleaning Test Method described herein is provided.

In even another example of the present invention, an article of manufacture comprising a dewatered emulsion comprising a continuous phase, for example a non-aqueous continuous phase, comprising a hydrocarbon fluid that exhibits a VOC content of less than 60% as measured according to the VOC Test Method described herein and a dispersed phase (discontinuous phase) comprising one or more water-soluble polymer particles comprising a soil adsorbing polymer, is provided.

In yet another example of the present invention, an article of manufacture comprising a dewatered emulsion comprising a continuous phase, for example a non-aqueous continuous phase, comprising a hydrocarbon fluid that exhibits a VOC content of less than 60% as measured according to the VOC Test Method described herein and a dispersed phase (discontinuous phase) comprising one or more water-soluble polymer particles comprising a soil adsorbing polymer wherein the article of manufacture exhibits an Average Soil Adsorption Value of greater than 90 and/or greater than 110 and/or greater than 120 and/or greater than 150 and/or greater than 175 and/or greater than 200 mg soil/g article of manufacture as measured according to the Soil Adsorption Test Method described herein, is provided.

In even still another example of the present invention, an article of manufacture comprising a dewatered emulsion comprising a continuous phase, for example a non-aqueous continuous phase, comprising a hydrocarbon fluid that exhibits a VOC content of less than 60% as measured according to the VOC Test Method described herein and a dispersed phase (discontinuous phase) comprising one or more water-soluble polymer particles comprising a soil adsorbing polymer wherein the article of manufacture exhibits an Average Mirror Densitometer Value of greater than −0.46 and/or greater than −0.30 and/or greater than −0.20 and/or greater than −0.15 as measured according to the Mirror Cleaning Test Method described herein, is provided.

In still yet another example of the present invention, an article of manufacture comprising a dewatered emulsion comprising a continuous phase, for example a non-aqueous continuous phase, comprising a hydrocarbon fluid that exhibits a VOC content of less than 60% as measured according to the VOC Test Method described herein and a dispersed phase (discontinuous phase) comprising one or more water-soluble polymer particles comprising a soil adsorbing polymer wherein the article of manufacture exhibits an Average Soil Adsorption Value of greater than 90 and/or greater than 110 and/or greater than 120 and/or greater than 150 and/or greater than 175 and/or greater than 200 mg soil/g article of manufacture as measured according to the Soil Adsorption Test Method described herein after being subjected to Stress Aging Procedure and/or Accelerated Aging Procedure described herein, is provided.

In even still another example of the present invention, an article of manufacture comprising a dewatered emulsion comprising a continuous phase, for example a non-aqueous continuous phase, comprising a hydrocarbon fluid that exhibits a VOC content of less than 60% as measured according to the VOC Test Method described herein and a dispersed phase (discontinuous phase) comprising one or more water-soluble polymer particles comprising a soil adsorbing polymer wherein the article of manufacture exhibits an Average Mirror Densitometer Value of greater than −0.46 and/or greater than −0.30 and/or greater than −0.20 and/or greater than −0.15 as measured according to the Mirror Cleaning Test Method described herein after being subjected to Stress Aging Procedure and/or Accelerated Aging Procedure described herein, is provided.

In another example of the present invention, a process for making an article of manufacture according to the present invention comprises the step of contacting an article of manufacture with a dewatered emulsion, for example a dewatered emulsion comprising 1) a continuous phase comprising a hydrocarbon fluid that exhibits a VOC content of less than 60% as measured according to the VOC Test Method described herein and 2) a dispersed phase comprising a plurality of water-soluble polymer particles such that the article of manufacture is formed is provided.

In still yet another example of the present invention, a process for making an article of manufacture comprising a dewatered emulsion according to the present invention, the process comprising the steps of:

a. providing an article of manufacture;

b. contacting the article of manufacture with a dewatered emulsion comprising a non-aqueous continuous phase comprising a hydrocarbon fluid that exhibits a VOC content of less than 60% as measured according to the VOC Test Method described herein and one or more water-soluble polymer particles, for example one or more water-soluble soil adsorbing polymer particles, dispersed in the non-aqueous continuous phase, such that the article of manufacture comprising the dewatered emulsion is formed, is provided.

In even yet another example of the present invention, an article of manufacture comprising a dewatered emulsion comprising:

a. a soil adsorbing polymer;
b. an inverting surfactant;
c. an emulsifying surfactant; and
d. non-aqueous continuous phase comprising a hydrocarbon fluid that exhibits a VOC content of less than 60% as measured according to the VOC Test Method described herein, is provided.

In even still yet another example of the present invention, an article of manufacture comprising a dewatered emulsion comprising:

a. a soil adsorbing polymer;
b. an inverting surfactant;
c. an emulsifying surfactant; and
d. a non-aqueous continuous phase comprising a hydrocarbon fluid that exhibits a VOC content of less than 60% as measured according to the VOC Test Method described herein; wherein the article of manufacture exhibits an Average Soil Adsorption Value of greater than 90 and/or greater than 110 and/or greater than 120 and/or greater than 150 and/or greater than 175 and/or greater than 200 mg soil/g article of manufacture as measured according to the Soil Adsorption Test Method described herein before and/or after being subjected to the Accelerated and Stress Aging Procedure described herein, is provided.

In still yet another example of the present invention, an article of manufacture comprising a dewatered emulsion comprising:

a. one or more polymer particles, for example polymer particles comprising a soil adsorbing polymer; and
b. a non-aqueous continuous phase comprising a hydrocarbon fluid that exhibits a VOC content of less than 60% as measured according to the VOC Test Method described herein The present invention provides articles of manufacture comprising a dewatered emulsion that overcomes the negatives associated with known articles of manufacture comprising dewatered emulsions as described above, and processes for making same.

BRIEF DESCRIPTION OF THE DRAWINGS

FIG. 1 is a schematic representation of a sample of article of manufacture used in the Mirror Cleaning Test Method described herein;

FIG. 2 is a schematic representation of 9 individual spectrodensitometer measurement spots on a surface of a mirror for the Mirror Cleaning Test Method.

DETAILED DESCRIPTION OF THE INVENTION

Definitions

"Article of manufacture" as used herein means any solid matter, such as a web, foam structure, or particle.

"Web" as used herein means a fibrous structure or a film.

"Fibrous structure" as used herein means a structure that comprises one or more fibrous filaments and/or fibers. In one example, a fibrous structure according to the present invention means an orderly arrangement of filaments and/or fibers within a structure in order to perform a function. Non-limiting examples of fibrous structures of the present invention include paper, fabrics (including woven, knitted, and non-woven), and absorbent pads (for example for diapers or feminine hygiene products).

Non-limiting examples of processes for making fibrous structures include known wet-laid processes, such as wet-laid papermaking processes, and air-laid processes, such as air-laid papermaking processes. Wet-laid and/or air-laid papermaking processes typically include a step of preparing a composition comprising a plurality of fibers that are suspended in a medium, either wet, more specifically aqueous medium, or dry, more specifically gaseous medium, such as air. The aqueous medium used for wet-laid processes is oftentimes referred to as a fiber slurry. The fiber composition is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

Non-limiting examples of other known processes and/or unit operations for making fibrous structures include fabric crepe and/or belt crepe processes, ATMOS processes, NTT processes, through-air-dried processes, uncreped through-air-dried processes, and conventional wet press processes.

Another process that can be used to produce the fibrous structures is a melt-blowing, dry spinning, and/or spunbonding process where a polymer composition is spun into filaments and collected on a belt to produce a fibrous structure. In one example, a plurality of fibers may be mixed with the filaments prior to collecting on the belt and/or a plurality of fibers may be deposited on a prior produced fibrous structure comprising filaments.

The fibrous structures of the present invention may be homogeneous or may be layered in the direction normal to the machine direction. If layered, the fibrous structures may comprise at least two and/or at least three and/or at least four and/or at least five layers.

The fibrous structures of the present invention may be co-formed fibrous structures. "Co-formed" as used herein means that the fibrous structure comprises a mixture of at least two different components wherein at least one of the components comprises a filament, such as a polypropylene filament, and at least one other component, different from the first component, comprises a solid additive, such as a fiber and/or a particulate. In one example, a co-formed fibrous structure comprises solid additives, such as fibers, such as wood pulp fibers and/or absorbent gel articles of manufacture and/or filler particles and/or particulate spot bonding powders and/or clays, and filaments, such as polypropylene filaments.

"Solid additive" as used herein means a fiber and/or a particulate.

"Particulate" as used herein means a granular substance or powder.

"Fiber" and/or "Filament" as used herein means an elongate particulate having an apparent length greatly exceeding its apparent width, i.e. a length to diameter ratio of at least about 10. In one example, a "fiber" is an elongate particulate as described above that exhibits a length of less than 5.08 cm (2 in.) and a "filament" is an elongate particulate as described above that exhibits a length of greater than or equal to 5.08 cm (2 in.).

Fibers are typically considered discontinuous in nature. Non-limiting examples of fibers include wood pulp fibers and synthetic staple fibers such as polyester fibers.

Filaments are typically considered continuous or substantially continuous in nature. Filaments are relatively longer than fibers. Non-limiting examples of filaments include meltblown and/or spunbond filaments. Non-limiting examples of articles of manufacture that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. Also applicable to the present invention are fibers derived from recycled paper, which may contain any or all of the above categories as well as other non-fibrous articles of manufacture such as fillers and adhesives used to facilitate the original papermaking In addition to the various wood pulp fibers, other cellulosic fibers such as cotton linters, rayon, lyocell and bagasse can be used in this invention. Other sources of cellulose in the form of fibers or capable of being spun into fibers include grasses and grain sources.

"Dry article of manufacture" as used herein means an article of manufacture that comprises less than 30% and/or less than 20% and/or less than 15% and/or less than 10% and/or less than 7% and/or less than 5% and/or less than 3% and/or less than 2% and/or less than 1% and/or less than 0.5% by weight of moisture as measured according to the Moisture Content Test Method described herein.

"Dry web" as used herein means a web that comprises less than 30% and/or less than 20% and/or less than 15% and/or less than 10% and/or less than 7% and/or less than 5% and/or less than 3% and/or less than 2% and/or less than 1% and/or less than 0.5% by weight of moisture as measured according to the Moisture Content Test Method described herein.

"Dry fibrous structure" as used herein means a fibrous structure that comprises less than 30% and/or less than 20% and/or less than 15% and/or less than 10% and/or less than 7% and/or less than 5% and/or less than 3% and/or less than 2% and/or less than 1% and/or less than 0.5% by weight of moisture as measured according to the Moisture Content Test Method described herein.

"Sanitary tissue product" as used herein means a soft, low density (i.e. <about 0.15 g/cm$^3$) web useful as a wiping implement for post-urinary and post-bowel movement cleaning (toilet tissue), for otorhinolaryngological discharges (facial tissue), multi-functional absorbent and cleaning uses (absorbent towels), and folded sanitary tissue products such as napkins and/or facial tissues including folded sanitary tissue products dispensed from a container, such as a box. The sanitary tissue product may be convolutedly wound upon itself about a core or without a core to form a sanitary tissue product roll.

In one example, the sanitary tissue product of the present invention comprises a fibrous structure according to the present invention.

The sanitary tissue products of the present invention may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$ as measured according to the Basis Weight Test Method described herein In addition, the sanitary tissue product of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$ as measured according to the Basis Weight Test Method described herein.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets. In one example, one or more ends of the roll of sanitary tissue product may comprise an adhesive and/or dry strength agent to mitigate the loss of fibers, especially wood pulp fibers from the ends of the roll of sanitary tissue product.

The sanitary tissue products of the present invention may comprises additives such as softening agents, temporary wet strength agents, permanent wet strength agents, bulk softening agents, lotions, silicones, wetting agents, latexes, especially surface-pattern-applied latexes, dry strength agents such as carboxymethylcellulose and starch, and absorbency aids.

"Basis Weight" as used herein is the weight per unit area of a sample reported in lbs/3000 ft$^2$ or g/m$^2$ and is measured according to the Basis Weight Test Method described herein.

"By weight of moisture" or "moisture content" means the amount of moisture present in an article of manufacture measured according to the Moisture Content Test Method described herein immediately after the article of manufacture has been conditioned in a conditioned room at a temperature of 73° F.±4° F. (about 23° C.±2.2° C.) and a relative humidity of 50%±10% for 2 hours.

"Water-soluble" as used herein means a material, such as a polymer, for example a soil adsorbing polymer that is miscible in water. In other words, a material that is capable of forming a stable (does not separate for greater than 5 minutes after forming the homogeneous solution) homogeneous solution with water at ambient conditions (about 23° C. and a relative humidity of about 50%).

"Machine Direction" or "MD" as used herein means the direction parallel to the flow of The fibrous structure through The fibrous structure making machine and/or sanitary tissue product manufacturing equipment.

"Cross Machine Direction" or "CD" as used herein means the direction parallel to the width of The fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

Articles of Manufacture

In one example of the present invention, the article of manufacture comprising a plurality of water-soluble polymer particles, for example water-soluble soil adsorbing polymer particles. In one example, the article of manufacture comprises a dewatered emulsion comprising a plurality of water-soluble polymer particles and a hydrocarbon fluid that exhibits a VOC content of less than 60% as measured according to the VOC Test Method described herein.

In one example, the article of manufacture of the present invention comprises a dry article of manufacture, for example a dry fibrous structure such as a dry paper towel, rather than a pre-moistened, liquid composition-containing towel or wipe or pad.

In one example, the article of manufacture of the present invention exhibits an Average Soil Adsorption Value of greater than 90 and/or greater than 100 and/or greater than 110 and/or greater than 125 and/or greater than 150 and/or greater than 175 and/or greater than 200 mg Soil/g of Article of Manufacture as measured according to the Soil Adsorption Test Method described herein before (initially) and after being subjected to the Accelerated and Stress Aging Procedures described herein.

In another example, the article of manufacture of the present invention exhibits an Average Mirror Cleaning Densitometer Value of greater than −0.5 and/or greater than −0.45 and/or greater than −0.38 and/or greater than −0.30 and/or greater than −0.25 and/or greater than −0.20 and/or greater than −0.15 as measured according to the Mirror Cleaning Test Method described herein before (initially) and after being subjected to the Accelerated and Stress Aging Procedures described herein.

It has been unexpectedly found that articles of manufacture comprising dewatered emulsions comprising a continuous phase, for example a non-aqueous continuous phase, comprising a hydrocarbon fluid that exhibits a VOC content of less than 60% and/or less than 50% and/or less than 40% and/or less than 30% and/or less than 20% and/or less than 10% and/or less than 5% and/or less than 1% as measured according to the VOC Test Method described herein and a discontinuous phase comprising one or more water-soluble soil adsorbing polymer particles provide equivalent and/or better Average Soil Adsorption Values as measured according to the Soil Adsorption Test Method described herein and/or Average Mirror Densitometer Values as measured according to the Mirror Cleaning Test Method described herein at least before (initially), but after being subjected to the Accelerated and Stress Aging Procedures described herein. Previously it was believed that a hydrocarbon fluid that exhibited a VOC content of greater than 70% was necessary in order to obtain the desired performance from the water-soluble soil adsorbing polymer particles.

Further, it has been unexpectedly found that using an increased level of inverting surfactant and/or using a soil adsorbing polymer that exhibits a net negative charge as measured according to the Charge Density Test Method described herein and/or using a soil adsorbing polymer that exhibits a net charge of from about −5 to about 5 meq/g and/or from about −5 to about −0.1 meq/g and/or using a lower VOC content hydrocarbon fluid, such as octyl stearate, and/or using a lower molecular weight soil adsorbing polymer as measured according to the UL Viscosity Test Method described herein mitigates the loss of soil adsorption performance of the soil adsorbing polymer.

In one example, the article of manufacture comprises a web. In another example, the article of manufacture comprises a particle, such as a powder or granule.

When the article of manufacture comprises a web, the web may comprise a fibrous structure. The fibrous structure may be a dry fibrous structure.

The fibrous structure of the present invention may comprise a plurality of pulp fibers. Further, the fibrous structure of the present invention may comprise a single-ply or multi-ply sanitary tissue product, such as a paper towel.

In another example, the article of manufacture of the present invention may comprise a web, for example a fibrous structure, in the form of a cleaning pad suitable for use with a cleaning device, such as a floor cleaning device, for example a Swiffer® cleaning pad or equivalent cleaning pads.

In still another example, the article of manufacture of the present invention may comprise a foam structure.

In one example, the soil adsorbing polymer present in the dewatered emulsion of the article of manufacture may be present in and/or on an article of manufacture in a pattern, such as a non-random repeating pattern composing lines and or letters/words, and/or present in and/or on regions of different density, different basis weight, different elevation and/or different texture of the article of manufacture. In one example, the soil adsorbing polymer present in and/or on an article of manufacture may provide a visual signal resulting from an increased concentration of soil adsorbed onto the soil adsorbing polymer In addition to the soil adsorbing polymer, the dewatered emulsion of the article of manufacture may comprise other ingredients, for example one or more surfactants. The surfactants may be present in and/or on the article of manufacture at a level of from about 0.01% to about 0.5% by weight of the article of manufacture. Non-limiting examples of suitable surfactants include $C_{8-16}$ alkyl polyglucoside, cocoamido propyl sulfobetaine, and mixtures thereof.

In one example, the article of manufacture comprises a signal, such as a dye and/or pigment, that becomes visible or becomes invisible to a consumer's eye when the article of manufacture adsorbs soil and/or when a soil adsorbing polymer present in and/or on the article of manufacture adsorbs soil. In another example, the signal may be a difference in texture of the article of manufacture or a difference in the physical state of the article of manufacture, for example the article of manufacture dissolves and/or vaporizes when the article of manufacture adsorbs soil.

Dewatered Emulsion

The dewatered emulsion of the present invention comprises a continuous phase, for example a non-aqueous continuous phase such as a hydrocarbon fluid phase, for example an oil and/or ester phase, and a dispersed phase (discontinuous phase) comprising one or more water-soluble polymer particles, for example water-soluble soil adsorbing polymer particles present in the continuous phase.

In one example, the dewatered emulsion comprises less than 7% and/or less than 5% and/or less than 3% and/or less than 1% to about 0% by weight of the dewatered emulsion of water. In another example, at least a portion of any water present in the dewatered emulsion is present in at least one of the particles of the dewatered emulsions of the present invention.

In one example, the neat dewatered emulsion may exhibit a bulk viscosity of less than 3000 cP as measured according to the Bulk Viscosity Test Method described herein. In another example, the neat dewatered emulsion may exhibit a bulk viscosity of greater than 50 cP as measured according to the Bulk Viscosity Test Method described herein. In one example, the neat dewatered emulsion exhibits bulk viscosity of from about 100 cP to about 3000 cP and/or from about 250 cP to about 2500 cP and/or from about 300 cP to about 1500 cP as measured according to the Bulk Viscosity Test Method described herein.

In another example, the dewatered emulsion as a whole may exhibit a VOC content of less than 5.5% and/or less than 3% and/or less than 1% and/or less than 0.75% as measured according to the VOC Test Method, described herein.

In one example, the dewatered emulsion comprises less than 500 ppm and/or less than 350 ppm and/or less than 200 ppm and/or less than 150 ppm and/or less than 50 ppm and/or no detectable level of residual acrylamide monomer as measured according to the Acrylamide Monomer Test Method described herein.

In one example, the dewatered emulsion may comprise two or more soil adsorbing polymers. In another example, the dewatered emulsion may comprise a blend (mixture) of two or more soil adsorbing polymers. In yet another example, the dewatered emulsion may comprise two or more different soil adsorbing polymers.

a. Hydrocarbon Fluid

In one example, the dewatered emulsion comprises a non-aqueous continuous phase comprising a hydrocarbon fluid. The hydrocarbon fluid exhibits a VOC content of less than 60% and/or less than 50% and/or less than 40% and/or less than 30% and/or less than 20% and/or less than 10% and/or less than 5% and/or less than 1% as measured according to the VOC Test Method described herein.

In one example, the hydrocarbon fluid comprises an oil, such as a mineral oil, for example white mineral oil, and/or a vegetable oil. Non-limiting examples of suitable oils are selected from the group consisting of: paraffinic oils (such as liquid paraffin, mineral oil, for example white mineral oil (Protol® is a white mineral oil commercially available from Sonneborn Refined Products) and mixtures thereof), naphthenic oils (such as cycloalkanes of the general formula $C_nH_{2(n+1-g)}$ wherein n is the number of carbon atoms, for example greater than 6 and/or greater than 8 and/or greater than 10, and g is the number of rings in the molecule, for example greater than 1 and/or greater than 2 and mixtures of such cycloalkanes).

In another example, the hydrocarbon fluid comprises an ester, such as a $C_4$-$C_{20}$ stearate, for example octyl stearate, and/or $C_4$-$C_{20}$ oleate, for example butyl oleate. Non-limiting examples of other suitable esters are selected from the group consisting of: synthetic ester oils prepared by the reaction of a carboxylic acid and an alcohol of the general formula $CH_3(CH_2)_xCO_2(CH_2)_yCH_3$ wherein x and y are independently from 1 to about 20 and/or from about 6 to about 20; additionally the hydrocarbon chains may be saturated, mono-unsaturated and/or polyunsaturated and exist as a water insoluble oil at 23° C.±1.0° C.

Non-limiting examples of other suitable hydrocarbon fluids are selected from the group consisting of: vegetable oil, for example triglycerides such as Safflower, Sunflower, Soybean, Canola, and Rapeseed oils, and mixtures thereof.

In one example, the hydrocarbon fluid is present in the dewatered emulsion at a level of at least 10% and/or at least 25% and/or at least 40% and/or to about 80% and/or to about 70% and/or to about 60% and/or to about 50% by weight of the dewatered emulsion.

b. Inverting Surfactant

The dewatered emulsion may comprise an inverting surfactant. In one example, an inverting surfactant is present in the dewatered emulsion at a level of at least 6% and/or greater than 6% and/or at least 9% and/or at least 12% to about 30% and/or to about 20% and/or to about 15% by weight of the dewatered emulsion. In another example, the inverting surfactant is present in the dewatered emulsion at a level of from about 0 to about 15% and/or from about 5 to about 13% by weight of the dewatered emulsion. The upper limit of the inverting surfactant level is only linked to the stability of the emulsion, once the inverting surfactant is added. In one example, 1 to 7% by weight of the dewatered emulsion of the inverting surface is enough to get a proper inversion in aqueous systems.

The inverting surfactant may improve the polymer's (water-soluble polymer particle polymer) dissolution in water.

In one example, the inverting surfactant comprises a nonionic surfactant. In another example, the inverting surfactant exhibits an HLB of at least 10, and/or from about 10 to 20 and/or from about 10 to about 15 and/or from about 10 to about 14.

In another example, the inverting surfactant is selected from the group consisting of: fatty alcohol ethoxylates for example Plurafac LF400, alkyl polyglucosides, ethoxylated sorbitan esters, for instance ethoxylated sorbitan oleate with 20 mequivalents of ethylene oxide (EO 20), Castor oil ethoxylate (Alkamuls EL-620), 2) Tridecyl alcohol ethoxylate (Alkamuls BC-720), Propylene oxide/ethylene oxide copolymer (ICI RA-290), nonyl phenol ethoxylate (Alkasurf CO-630), and propylene oxide/ethylene oxide copolymer (ICI RA-280). Certain silicone compounds such as dimethicone copolyols may also be used as inverting surfactants.

In one example, a portion of the inverting surfactant present in the dewatered emulsion may be present in at least one of the water-soluble polymer particles present in the dewatered emulsion.

In another example, at least a portion and/or a majority and/or substantially all, if not all, of the inverting surfactant present in the dewatered emulsion is present in the continuous phase (hydrocarbon fluid) of the dewatered emulsion.

c. Emulsifying Surfactant

The dewatered emulsion may also comprise an emulsifying surfactant. In one example, an emulsifying surfactant is present in the dewatered emulsion at a level of at least 1% and/or at least 2% and/or at least 3% and/or at least 4% to about 20% and/or to about 10% and/or to about 6% by weight of the dewatered emulsion.

In one example, the emulsifying surfactant comprises a nonionic surfactant. In another example, the emulsifying surfactant exhibits an HLB of less than 10 and/or from about 3 to about 8.

In one example the emulsifying surfactant includes sorbitan monooleate and/or sorbitan isostearate. Non-limiting examples of other suitable emulsifying surfactants include those surfactants described U.S. Pat. No. 6,686,417, for example sorbitan fatty acid esters, such as the mono, sesqui, and/or tri-fatty acid esters, for example $C_{14}$ to $C_{20}$ mono-unsaturated fatty acid like oleic acid, esters and sorbitan mono-oleate; glycerol mono and/or di-fatty acid esters, for example $C_{14}$ to $C_{20}$ mono-unsaturated fatty acid, such as oleic acid, esters; and fatty acid alkanolamides, for example those ethanolamides, such as diethanolamides, for example those diethanolamides based on $C_{14}$ to $C_{20}$ mono-unsaturated fatty acids, such as oleic acid. The oleic acid in such compounds may be provided by mixed fatty acid feedstocks e.g. rape seed fatty acids, including $C_{14}$ to $C_{20}$ mono-unsaturated fatty acid, particularly oleic acid, as a main constituent. In one example, the emulsifying surfactants include those commercially available from ICI Surfactant under the trade name Span 80. Additional non-limiting examples of emulsifying surfactants include ethylene oxide propylene oxide block copolymers, alkylene (generally ethylene) oxide condensates of alkyl phenols or fatty alcohols, and polyalkylene (generally ethylene) glycol condensates of fatty acids. Suitable materials are ethylene oxide condensates of octyl phenol or nonyl phenol, ethylene oxide condensates of fatty alcohols such as blends of cetyl and oleyl alcohol or C9-11 alkyl alcohols, polyethylene glycol 200, 300 or 400 oleates of the isopropylamine salt of dodecyl benzene sulphonate.

In one example, the emulsifying surfactant is associated with, for example present in and/or present on, the water-soluble polymer particle to keep the water-soluble polymer particle dispersed within the continuous phase, for example the hydrocarbon fluid within the dewatered emulsion of the present invention.

In one example, at least a portion and/or a majority and/or substantially all, if not all, of the emulsifying surfactant present in the dewatered emulsion is present in and/or on at least one of the water-soluble polymer particles within the dewatered emulsion.

In another example, a portion of the emulsifying surfactant present in the dewatered emulsion may be present in the continuous phase (hydrocarbon fluid) of the dewatered emulsion.

d. Water-Soluble Polymer Particles

One or more water-soluble polymer particles, such as water-soluble soil adsorbing polymer particles, may be dispersed within the continuous phase (hydrocarbon fluid) of the dewatered emulsion.

In one example, the water-soluble polymer particles are present in the dewatered emulsion at a level of greater than 10% and/or greater than 15% and/or greater than 20% and/or greater than 30% and/or greater than 50% by weight of the dewatered emulsion.

In one example, the water-soluble polymer particles, for example water-soluble soil adsorbing polymer particles, are in and/or on the article of manufacture at a level of greater than 0.005% and/or greater than 0.0075% and/or greater than 0.01% and/or greater than 0.05% and/or greater than 0.1% and/or greater than 0.15% and/or greater than 0.2% and/or less than 5% and/or less than 3% and/or less than 2% and/or less than 1% by weight of the article of manufacture. In one example, the water-soluble polymer particle is present in and/or on the article of manufacture at a level of from about 0.005% to about 1% by weight of the article of manufacture.

In another example of the present invention, the article of manufacture may comprise the water-soluble polymer particles, for example water-soluble soil adsorbing polymer particles, at a level of from greater than 0 pounds/ton (#/ton) and/or greater than 0.1 #/ton and/or greater than 0.5 #/ton and/or greater than 1 #/ton and/or greater than 2 #/ton and/or greater than 3 #/ton and/or to less than 20 #/ton and/or to less than 15 #/ton and/or to less than 10 #/ton and/or to less than 6 #/ton and/or to 5 #/ton or less and/or to 4 #/ton or less by weight of the article of manufacture.

The level of water-soluble polymer particles, such as water-soluble soil adsorbing polymer particles, present in and/or on an article of manufacture as used herein according to the present invention is in terms of active solids basis of the soil adsorbing polymer.

In one example, the water-soluble polymer particles, when present on an article of manufacture of the present invention, are non-aqueous and/or dry and/or void of water (for example less than 10% and/or less than 7% and/or less than 5% and/or less than 3% to 0 or about 0% by weight of the water-soluble polymer particle). This clearly distinguishes the water-soluble polymer particles from latex, which is an aqueous emulsion of polymers.

One or more of the water-soluble polymer particles of the present invention comprises a water-soluble soil adsorbing polymer. Without wishing to be bound by theory, it is believed that the water-soluble polymer, for example the water-soluble soil adsorbing polymer, present on an article of manufacture of the present invention is in a coiled configuration until exposed to excess polar solvent, for example water, at which time it uncoils to an extended functional form to provide its benefits, for example soil adsorbing benefits.

In one example, the water-soluble polymer particle, for example water-soluble soil adsorbing polymer particle, comprises the water-soluble soil adsorbing polymer, and an emulsifying surfactant.

In one example, the water-soluble polymer particle exhibits an average particle size of from about 500 nm to about 50 μm and/or from about 700 nm to about 25 μm and/or from about 800 nm to about 10 μm and/or from about 800 nm to about 5 μm and/or from about 800 nm to about 1 μm.

e. Soil Adsorbing Polymer

The soil adsorbing polymer of the present invention may be present in one or more water-soluble polymer particles of the present invention.

The soil adsorbing polymer of the present invention may comprise a nonionic monomeric unit, such as a nonionic monomeric unit derived from an acrylamide compound. Non-limiting examples of suitable nonionic monomeric units include nonionic monomeric units derived from nonionic monomers selected from the group consisting of: hydroxyalkyl esters of α,β-ethylenically unsaturated acids, such as hydroxyethyl or hydroxypropyl acrylates and methacrylates, glyceryl monomethacrylate, α,β-ethylenically unsaturated amides such as acrylamide, N,N-dimethylmethacrylamide, N-methylolacrylamide, α,β-ethylenically unsaturated monomers bearing a water-soluble polyoxyalkylene segment of the poly(ethylene oxide) type, such as poly(ethylene oxide) α-methacrylates (Bisomer S20W, S10W, etc., from Laporte) or α,β-dimethacrylates, Sipomer BEM from Rhodia (ω-behenyl polyoxyethylene methacrylate), Sipomer SEM-25 from Rhodia (ω-tristyrylphenyl polyoxyethylene methacrylate), α,β-ethylenically unsaturated monomers which are precursors of hydrophilic units or segments, such as vinyl acetate, which, once polymerized, can be hydrolyzed in order to give rise to vinyl alcohol units or polyvinyl alcohol segments, vinylpyrrolidones, α,β-ethylenically unsaturated monomers of the ureido type, and in particular 2-imidazolidinone-ethyl methacrylamide (Sipomer WAM II from Rhodia). Other nonionic monomeric units suitable for the present invention include nonionic monomeric units derived from nonionic monomers selected from the group consisting of: vinylaromatic monomers such as styrene, alpha-methylstyrene, vinyltoluene, vinyl halides or vinylidene halides, such as vinyl chloride, vinylidene chloride, $C_1$-$C_{12}$ alkylesters of α,β-monoethylenically unsaturated acids such as methyl, ethyl or butyl acrylates and methacrylates, 2-ethylhexyl acrylate, vinyl esters or allyl esters of saturated carboxylic acids, such as vinyl or allyl acetates, propionates, versatates, stearates, α,β-monoethylenically unsaturated nitriles containing from 3 to 12 carbon atoms, such as acrylonitrile, methacrylonitrile, α-olefins such as ethylene, conjugated dienes, such as butadiene, isoprene, chloroprene.

The soil adsorbing polymer of the present invention may comprise an anionic monomeric unit, such as an anionic monomeric unit derived from acrylic acid. Non-limiting examples of anionic monomeric units suitable for the present invention include anionic monomeric units derived from anionic monomers selected from the group consisting of: monomers having at least one carboxylic function, for instance α,β-ethylenically unsaturated carboxylic acids or the corresponding anhydrides, such as acrylic, methacrylic or maleic acids or anhydrides, fumaric acid, itaconic acid, N-methacroylalanine, N-acryloylglycine, and their water-soluble salts, monomers that are precursors of carboxylate functions, such as tert-butyl acrylate, which, after polymerization, give rise to carboxylic functions by hydrolysis, monomers having at least one sulfate or sulfonate function, such as 2-sulfooxyethyl methacrylate, vinylbenzene sulfonic acid, allyl sulfonic acid, 2-acrylamido-2-methylpropane sulfonic acid (AMPS), sulfoethyl acrylate or methacrylate, sulfopropyl acrylate or methacrylate, and their water-soluble salts, monomers having at least one phosphonate or phosphate function, such as vinylphosphonic acid, etc., the esters of ethylenically unsaturated phosphates, such as the phosphates derived from hydroxyethyl methacrylate (Empicryl 6835 from Rhodia) and those derived from polyoxyalkylene methacrylates, and their water-soluble salts, and 2-carboxyethyl acrylate (CEA).

In one example, the soil adsorbing polymer comprises a nonionic monomeric unit derived from an acrylamide compound and an anionic monomeric unit derived from acrylic acid.

The soil adsorbing polymer of the present invention may comprise a cationic monomeric unit, such as a cationic monomeric unit derived from cationic monomers selected from the group consisting of: N,N-(dialkylamino-ω-alkyl) amides of α,β-monoethylenically unsaturated carboxylic acids, such as N,N-dimethylaminomethylacrylamide or -methacrylamide, 2-(N,N-dimethylamino)ethylacrylamide or -methacrylamide, 3-(N,N-dimethylamino)propylacrylamide or -methacrylamide, and 4-(N,N-dimethylamino)butylacrylamide or -methacrylamide, α,β-monoethylenically unsaturated amino esters such as 2-(dimethylamino)ethyl acrylate (DMAA), 2-(dimethylamino)ethyl methacrylate (DMAM), 3-(dimethylamino)propyl methacrylate, 2-(tert-butylamino)ethyl methacrylate, 2-(dipentylamino)ethyl methacrylate, and 2(diethylamino)ethyl methacrylate, vinylpyridines, vinylamine, vinylimidazolines, monomers that are precursors of amine functions such as N-vinylformamide, N-vinylacetamide, which give rise to primary amine functions by simple acid or base hydrolysis, acryloyl- or acryloyloxyammonium monomers such as trimethylammonium propyl methacrylate chloride, trimethylammonium ethylacrylamide or -methacrylamide chloride or bromide, trimethylammonium butylacrylamide or -methacrylamide methyl sulfate, trimethylammonium propylmethacrylamide methyl sulfate, (3-methacrylamidopropyl)trimethylammonium chloride (MAPTAC), (3-methacrylamidopropyl)trimethylammonium methyl sulphate (MAPTA-MES), (3-acrylamidopropyl)trimethylammonium chloride (APTAC), methacryloyloxyethyl-trimethylammonium chloride or methyl sulfate, and acryloyloxyethyltrimethylammonium chloride; 1-ethyl-2-vinylpyridinium or 1-ethyl-4-vinylpyridinium bromide, chloride or methyl sulfate; N,N-dialkyldiallylamine monomers such as N,N-dimethyldiallylammonium chloride (DADMAC); polyquaternary monomers such as dimethylaminopropylmethacrylamide chloride and N-(3-chloro-2-hydroxypropyl)trimethylammonium (DIQUAT) and 2-hydroxy-$N^1$-(3-(2((3-methacrylamidopropyl)dimethylammino)-acetamido)propyl)-$N^1$, $N^1$, $N^3$, $N^3$, $N^3$-pentamethylpropane-1,3-diaminium chloride (TRIQUAT), and. In one example, the cationic monomeric unit comprises a quaternary ammonium monomeric unit, for example a monoquaternary ammonium monomeric unit, a diquaternary ammonium monomeric unit and a triquaternary monomeric unit. In one example, the cationic monomeric unit is derived from MAPTAC. In another example, the cationic monomeric unit is derived from DADMAC. In still another example, the cationic monomeric unit is derived from 2-hydroxy-$N^1$-(3-(2((3-methacrylamidopropyl)dimethylammino)-acetamido)propyl)-$N^1$, $N^1$, $N^3$, $N^3$, $N^3$-pentamethylpropane-1,3-diaminium chloride.

f. Optional Additives.

Optional additives may be added to the dewatered emulsion of the present invention. For example, sodium bisulfite may be added to the dewatered emulsion after completion of polymerization of the water-soluble polymer particle, for example water-soluble soil adsorbing polymer particle, to aid in the reduction of residual acrylamide monomer that may be present in the neat dewatered emulsion. One can also utilize anionic dispersants, for example a carboxylic acid, to aid in maintaining stability of the emulsion, for example the dewatered emulsion.

In one example, the soil adsorbing polymer exhibits a negative charge density as measured according to the Charge Density Test Method, described herein. In another example, the soil adsorbing polymer exhibits a net charge density of greater than −5 meq/g to less than 5 meq/g and/or from greater than −5 to about −0.1 meq/g as measured according to the Charge Density Test Method, described herein.

In one example, the soil adsorbing polymer of the present invention exhibits a UL Viscosity of from about 1 to about 6 cP as measured according to the UL Viscosity Test Method described herein.

The soil adsorbing polymer may be present in the dewatered emulsion at a level of greater than 10% and/or greater than 25% and/or greater than 30% and/or greater than 40% and/or greater than 50% and/or to about 90% and/or to about 75% and/or to about 65% by weight of the dewatered emulsion. In one example, the soil adsorbing polymer is present in the dewatered emulsion at a level of from about 30% to about 75% and/or from about 40% to 65% by weight of the dewatered emulsion.

In one example, the soil adsorbing polymer is present in and/or on the article of manufacture at a level of greater than 0.005% by weight of the article of manufacture. In another example, the soil adsorbing polymer is present in the article of manufacture at a level of from about 0.005% to about 5% and/or from about 0.005% to about 3% by weight of the article of manufacture.

Process for Making Dewatered Emulsion

The dewatered emulsions of the present invention may be made by any suitable process known in the art. A non-limiting example of a suitable process follows.

First, an inverse emulsion is prepared by dispersing a non-continuous phase (discontinuous phase), such as an aqueous phase, in a continuous phase, such as a non-aqueous continuous phase, for example an oil phase as follows. The aqueous phase is prepared by mixing one or more water-soluble, ethylenically unsaturated addition polymerizable monomers such as acrylamide and/or acrylic acid, and optionally, a water-soluble salt, such as alkali salts such as sodium chloride, sodium bromide, lithium chloride, lithium bromide, in water. When present, the water-soluble salt may be present in the dewatered emulsion at a level of from about 0% to about 4% and/or from about 0.05% to about 2% by weight of the dewatered emulsion. The oil phase is prepared by mixing an emulsifying surfactant and an inverting surfactant in a hydrocarbon fluid, such as an oil, for example white mineral oil, that exhibits a VOC content of less than 60% as measured according to the VOC Test Method described herein.

Next, a chemical free radical initiator is added to either the aqueous phase or the oil phase depending upon the solubility characteristics of the initiator.

The aqueous phase (discontinuous phase) is then dispersed into the oil phase (continuous phase). The water-soluble monomers are then polymerized within the aqueous phase thus resulting in an inverse emulsion comprising a water-soluble polymer, for example a water-soluble soil adsorbing polymer.

The inverse emulsion (water-in-oil emulsion) is then dehydrated, for example by azeotropic distillation, to produce a dewatered emulsion (dewatered inverse emulsion) of the present invention comprising a plurality of water-soluble polymer particles dispersed throughout the oil (hydrocarbon fluid) continuous phase.

Process for Making Article of Manufacture

An article of manufacture suitable for use in the present invention may be made by any suitable process known in the art. For example, if the article of manufacture is a web, any suitable web making process can be used.

In one example, the article of manufacture of the present invention comprises a fibrous structure. In order to make the article of manufacture comprising water-soluble polymer particles and a hydrocarbon fluid that exhibits a VOC content of less than 60% as measured according to the VOC Test Method described herein and/or a dewatered emulsion comprising such water-soluble polymer particles and hydrocarbon fluid of the present invention, the fibrous structure is contacted with the water-soluble polymer particles and a hydrocarbon fluid and/or the dewatered emulsion of the present invention.

In another example, a process for making an article of manufacture, such as a wet-laid fibrous structure, comprising a dewatered emulsion of the present invention comprises the steps of:

a. providing a fiber slurry;
b. depositing the fiber slurry onto a foraminous wire to form an embryonic web;
c. drying the embryonic web, for example at least partially on a patterned belt, to produce a fibrous structure; and
d. contacting the fibrous structure with a dewatered emulsion of the present invention to produce an article of manufacture (a fibrous structure, for example a dry fibrous structure) comprising a dewatered emulsion of the present invention.

In yet another example, a process for making an article of manufacture, such as a wet-laid fibrous structure, comprises the steps of:

a. providing a fiber slurry;
b. adding a dewatered emulsion comprising a water-soluble polymer, for example a water-soluble soil adsorbing polymer to the fiber slurry after the dewatered emulsion is inverted into an aqueous emulsion (for example by utilizing procedures as outlined by the supplier of the dewatered emulsion);
c. depositing the fiber slurry onto a foraminous wire to form an embryonic web; and
d. drying the embryonic web, for example at least partially on a patterned belt; and
e. contacting the article of manufacture with a dewatered emulsion of the present invention to produce an article of manufacture (a fibrous structure, for example a dry fibrous structure) comprising a dewatered emulsion of the present invention.

The fiber slurries and/or articles of manufacture and/or fibrous structures may comprise permanent and/or temporary wet strength agents such as Kymene® (permanent wet strength) and Hereobond® (temporary wet strength) both available from Ashland Inc. and/or Parez® (wet strength chemistries) available from Kemira Chemicals, Inc.

The fiber slurries and/or articles of manufacture and/or fibrous structures may comprise dry strength agents such as carboxymethylcellulose, starch, polyvinylamides, polyethyleneimines, melamine/formaldehyde, epoxide, and mixtures thereof.

In still yet another example, a process for making an article of manufacture, such as an air-laid fibrous structure, comprises the steps of:

a. providing pulp fibers;
b. producing an air-laid fibrous structure from the pulp fibers; and
c. optionally applying a binder, for example a latex binder, to a surface of the air-laid fibrous structure; and
d. contacting the air-laid fibrous structure with a dewatered emulsion of the present invention to produce an article of manufacture comprising a dewatered emulsion of the present invention.

In one example, the dewatered emulsion of the present invention may be added to a fibrous structure during papermaking, between the Yankee dryer and the reel, and/or during converting by applying it to one or more surfaces of the fibrous structure. In one example, a single-ply paper towel comprises the dewatered emulsion of the present invention on one surface of the paper towel. In another example, a single-ply paper towel comprises the dewatered emulsion of the present invention on both surfaces of the paper towel. In still another example, a two-ply paper towel comprises the dewatered emulsion of the present invention on one or both exterior surfaces of the two-ply paper towel. In still another example, a two-ply paper towel comprises the dewatered emulsion of the present invention on one or more interior surfaces of the two-ply paper towel. In yet another example, a two-ply paper towel comprises the dewatered emulsion of the present invention on one or more exterior surfaces and one or more interior surfaces of the two-ply paper towel. One of ordinary skill would understand that one or more exterior surfaces and one or more interior surfaces of a three or more ply paper towel could comprise the dewatered emulsion of the present invention.

In another example, the article of manufacture comprising a dewatered emulsion of the present invention may be made by printing a dewatered emulsion onto a surface of an article of manufacture, such as a fibrous structure, for example in a converting operation. The printing operation may occur by any suitable printing equipment, for example by way of a gravure roll and/or by a permeable fluid applicator roll. In still another example, an article of manufacture comprising a dewatered emulsion of the present invention may be made by extruding a dewatered emulsion onto a surface of an article of manufacture, such as a fibrous structure.

In even another example, an article of manufacture comprising a dewatered emulsion of the present invention may be made by spraying a dewatered emulsion onto a surface of an article of manufacture, such as a fibrous structure. In yet another example, an article of manufacture comprising a dewatered emulsion of the present invention may be made by spraying a dewatered emulsion onto a wet fibrous structure during papermaking after the vacuum dewatering step, but before the pre-dryers and/or after the pre-dryers, but before the Yankee.

In even yet another example, an article of manufacture comprising a dewatered emulsion of the present invention may be made by depositing a plurality of fibers mixed with a dewatered emulsion of the present invention in an air-laid and/or coform process.

In still another example, an article of manufacture comprising a dewatered emulsion of the present invention may be made by adding one or more dewatered emulsions of the present invention at acceptable locations within spunbonding, meltblowing, dry spinning, carding, and/or hydroentangling processes.

The dewatered emulsion of the present invention, and in particular the soil adsorbing polymer, may be applied to and/or included in an article of manufacture, for example a fibrous structure, in a pattern, such as a non-random, repeating pattern.

NON-LIMITING EXAMPLES

Example 1

Examples of articles of manufacture, specifically fibrous structures; namely, paper towels for use in the comparative and inventive examples below are produced utilizing a cellulosic pulp fiber furnish consisting of about 55% refined softwood furnish consisting of about 44% Northern Bleached Softwood Kraft (Bowater), 44% Northern Bleached Softwood Kraft (Celgar) and 12% Southern Bleached Softwood Kraft (Alabama River Softwood, Weyerhaeuser); about 30% of unrefined hardwood Eucalyptus Bleached Kraft consisting of about 80% (Fibria) and 20% NBHK (Aspen) (Peace River); and about 15% of an unrefined furnish consisting of a blend of about 27% Northern Bleached Softwood Kraft (Bowater), 27% Northern Bleached Softwood Kraft (Celgar), 42% Eucalyptus Bleached Kraft (Fibria) and 7% Southern Bleached Kraft (Alabama River Softwood, Weyerhaeuser). The 55% refined softwood is refined as needed to maintain target wet burst at the reel. Any furnish preparation and refining methodology common to the papermaking industry can be utilized.

A 3% active solution Kymene 5221 is added to the refined softwood line prior to an in-line static mixer and 1% active solution of Wickit 1285, an ethoxylated fatty alcohol available from Ashland Inc. is added to the unrefined Eucalyptus Bleached Kraft (Fibria) hardwood furnish. The addition levels are 21 and 1 lbs active/ton of paper, respectively.

The refined softwood and unrefined hardwood and unrefined NBSK/SSK/Eucalyptus bleached kraft/NDHK thick stocks are then blended into a single thick stock line followed by addition of 1% active carboxymethylcellulose (CMC-Finnfix) solution at 7 lbs active/ton of paper towel, and optionally, a softening agent may be added.

The thick stock is then diluted with white water at the inlet of a fan pump to a consistency of about 0.15% based on total weight of softwood, hardwood and simulated broke fiber. The diluted fiber slurry is directed to a non layered configuration headbox such that the wet web formed onto a Fourdrinier wire (foraminous wire). Optionally, a fines retention/drainage aid may be added to the outlet of the fan pump.

Dewatering occurs through the Fourdrinier wire and is assisted by deflector and vacuum boxes. The Fourdrinier wire is of a 5-shed, satin weave configuration having 87 machine-direction and 76 cross-direction monofilaments per inch, respectively. The speed of the Fourdrinier wire is about 750 fpm (feet per minute).

The embryonic wet web is transferred from the Fourdrinier wire at a fiber consistency of about 24% at the point of transfer, to a belt, such as a patterned belt through-air-drying resin carrying fabric. In the present case, the speed of the patterned through-air-drying fabric is approximately the same as the speed of the Fourdrinier wire. In another case, the embryonic wet web may be transferred to a patterned belt and/or fabric that is traveling slower, for example about 20% slower than the speed of the Fourdrinier wire (for example a wet molding process).

Further de-watering is accomplished by vacuum assisted drainage until the web has a fiber consistency of about 30%.

While remaining in contact with the patterned belt, the web is pre-dried by air blow-through pre-dryers to a fiber consistency of about 65% by weight.

After the pre-dryers, the semi-dry web is transferred to a Yankee dryer and adhered to the surface of the Yankee dryer with a sprayed creping adhesive. The creping adhesive is an aqueous dispersion with the actives consisting of about 75% polyvinyl alcohol, and about 25% CREPETROL® R6390. Optionally a crepe aid consisting of CREPETROL® A3025 may be applied. CREPETROL® R6390 and CREPETROL® A3025 are commercially available from Ashland Inc. (formerly Hercules Inc.). The creping adhesive diluted to about 0.15% adhesive solids and delivered to the Yankee surface at a rate of about 2# adhesive solids based on the dry weight of the web. The fiber consistency is increased to about 97% before the web is dry creped from the Yankee with a doctor blade.

In the present case, the doctor blade has a bevel angle of about 45° and is positioned with respect to the Yankee dryer to provide an impact angle of about 101° and the reel is run at a speed that is about 15% faster than the speed of the Yankee. In another case, the doctor blade may have a bevel angle of about 25° and be positioned with respect to the Yankee dryer to provide an impact angle of about 81° and the reel is run at a speed that is about 10% slower than the speed of the Yankee. The Yankee dryer is operated at a temperature of about 177° C. and a speed of about 800 fpm. The fibrous structure is wound in a roll using a surface driven reel drum having a surface speed of about 656 feet per minute.

The fibrous structure may be subsequently converted into a two-ply paper towel product (an article of manufacture) having a basis weight of about 45 to 54 g/m$^2$. This two-ply paper towel product is the Paper Control or Control in Table 1 below.

Example 1A

Comparative Example

An inverse (water-in-oil) emulsion commercially available from Hychem, Inc. under the trade name Hyperfloc® NE823F (about 30% polyacrylamide (soil adsorbing polymer), about 30% water, about 30% oil exhibiting a VOC content of greater than 70% as measured according to the VOC Test Method described herein, and about 10% emulsifying and/or inverting surfactants) with the polyacrylamide being in the form of highly coiled particles dissolved in micron size water droplets is applied directly to a surface of the two-ply paper towel product in the converting operation via an extruder.

Example 1B

Comparative Example

A dewatered emulsion (dewatered inverse emulsion) commercially available from Hychem, Inc. under the trade name Hyperfloc® ND823 (about 50% polyacrylamide (soil adsorbing polymer), about 40% oil exhibiting a VOC content of greater than 70% as measured according to the VOC Test Method described herein, and about 10% emulsifying and/or inverting surfactants), which is a dewatered form of NE823F, with the polyacrylamide being in the form of micron size highly coiled particles dispersed in the oil is applied directly to a surface of the two-ply paper towel product in the converting operation via an extruder.

Example 1C

Inventive Example

An example of a dewatered emulsion (dewatered inverse emulsion) of the present invention, referred to as ND823A, (about 50% polyacrylamide (soil adsorbing polymer), about 40% oil (white mineral oil) exhibiting a VOC content of less than 60%, and about 10% emulsifying and/or inverting surfactants) with the polyacrylamide being in the form of micron size highly coiled particles dispersed in the oil is applied directly to a surface of the two-ply paper towel product in the converting operation via an extruder.

The fibrous structure plies and/or two-ply paper towel product may be embossed prior to and/or subsequent to the application of the emulsions (Examples 1A-1C).

Table 1 below shows Average Soil Adsorption Values (mg Soil/g Paper Towel) as measured according to the Soil Adsorption Value Test Method described herein before (initial—0 Day) and after (14 Day) being subjected to the Stress Aging Procedure (without use of external packaging) described herein for Control and Examples 1A (NE823F, an inverse emulsion—Comparative Example), 1B (ND823, a dewatered emulsion comprising an oil that exhibits a VOC content of greater than 70%—Comparative Example), and 1C (ND823A, a dewatered emulsion comprising an oil that exhibits a VOC content of less than 60%-Inventive Example).

TABLE 1

| Stress Aging @ 50° C./60% RH | | | | |
|---|---|---|---|---|
| Days | NE823F | ND823 | ND823A | Control |
| 0 | 215 | 200 | 196 | 114 |
| 14 | 161 | 151 | 97 | 96 |

Table 1 shows that equivalent initial soil adsorption performance is achieved with 1) a dewatered emulsion (ND823A) of the present invention comprising a continuous phase comprising a hydrocarbon fluid that exhibits a lower VOC content (less than 60% as measured according to the VOC Test Method described herein); 2) a prior art dewatered emulsion (ND823) comprising a continuous phase comprising a hydrocarbon fluid that exhibits a higher VOC content (greater than 70% as measured according to the VOC Test Method described herein); and 3) a prior art inverse emulsion (NE823F) comprising a continuous phase comprising a hydrocarbon fluid that exhibits a higher VOC content (greater than 70% as measured according to the VOC Test Method described herein).

Table 1 also shows that examples of the dewatered emulsion of the present invention (ND823A) also loses soil adsorption performance (about 50% of its initial soil adsorption performance, i.e. all or nearly all of its advantage over the Control with no soil adsorbing polymer present) after being subjected to the Stress Aging procedure described herein.

In addition, Table 1 shows that the prior art dewatered emulsions (NE823F and ND823) lose soil adsorption performance (about 25% of their initial soil adsorption performance) after being subjected to the Stress Aging Procedure.

Example 2

Two-ply paper towel products made according to Example 1 above are used for this Example 2.

Two-ply paper towel products comprising commercially available dewatered emulsions (Hyperfloc® ND823, AD859, and CD 864), all of which contain a high VOC content oil (greater than 70% VOC content as measured according to the VOC Test Method described herein), and examples of dewatered emulsions of the present invention (ND823A, KY2438 A-G 1004, KY2439 A-C 1001, and LC 3095 C). The formulations of the dewatered emulsions set forth in Table 2 below, are made by applying 0.9 # soil adsorbing polymer/ton of two-ply paper towel product via an extruder onto one side (embossed side) of the two-ply paper towel products. Additionally, where sufficient material was available a second extruder is utilized to apply 0.9 # soil adsorbing polymer/ton of two-ply paper towel product via an extruder to the other side of some of the two-ply paper towel products resulting in a total add-on of soil adsorbing polymer of about 1.8 # soil adsorbing polymer/ton of two-ply paper towel product.

TABLE 2

| Dewatered Emulsion Lot Number | % Active | Continuous Oil Phase | % Emulsifying Surfactant | % Inverting Surfactant | % Anionic Monomer | Bulk Viscosity | M. Wt (UL Viscosity) | Charge Demand (meq/gm) | AAM Monomer in Emulsion | % VOC |
|---|---|---|---|---|---|---|---|---|---|---|
| ND823A | 50 | WMO | 4 | 6 | 0 | 1025 Cp | 4 to 6 | — | 71 ppm | 2.91 |
| Hyperfloc ND823 | 50 | LPA210 | 4 | 6 | 0 | | 4 to 6 | — | 71 ppm | 8.73 |
| KY2438A1004 | 50 | WMO | 4 | 6 | 3 | 500 Cp | 5.4 | ND | 60 ppm | 2.95 |
| KY2438B1004 | 50 | WMO | 4 | 6 | 6 | 520 Cp | 5.4 | −1.13 | 62 ppm | 3.25 |
| KY2438C1004 | 50 | WMO | 4 | 6 | 9 | 680 Cp | 5.4 | −1.465 | 61 ppm | 2.51 |
| KY2438D1004 | 50 | WMO | 4 | 6 | 0 | 480 Cp | 1 to 2 | — | 106 ppm | 3.44 |
| KY2438E1004 | 50 | WMO | 4 | 6 | 3 | 480 Cp | 1 to 2 | −0.608 | 60 ppm | 3.25 |
| KY2438F1004 | 50 | WMO | 4 | 6 | 6 | 520 Cp | 1 to 2 | −1.17 | 93 ppm | 3.17 |
| KY2438G1004 | 50 | WMO | 4 | 6 | 9 | 480 Cp | 1 to 2 | −1.485 | 85 ppm | 2.52 |
| KY2439A1001 | 50 | WMO | 4 | 6 | 0 | 500 Cp | 5.4 | — | 77 ppm* | 2.11 |
| KY2439B1001 | 48.5 | WMO | 3.8 | 9 | 0 | 520 Cp | 5.4 | — | 77 ppm* | 2.77 |
| KY2439C1001 | 46.9 | WMO | 3.6 | 12 | 0 | 760 Cp | 5.4 | — | 77 ppm* | 3.19 |
| LC 3095 C | 50 | OS | 4 | 6 | 0 | 400 Cp | 3.86 | — | 450 ppm | <5 |
| Hyperfloc AD859 | 50 | LPA210 | 4 | 6 | ND | 1380 Cp | 7.46 | −4.975 | 10 ppm | 9.3 |
| Hyperfloc CD864 | 50 | LPA210 | 4 | 6 | NA | 400 Cp | 4.06 | — | 65 ppm | 5.5 |

VOC Content of Continuous Oil Phase

| | % Total Volatile | % Moisture | % VOC |
|---|---|---|---|
| LPA 210 | 71.98 | 0.72 | 71.18 |
| OS (octyl stearate) | 0.5 | 0.1 | 0.4 |
| WMO (Protol) | 0.32 | 0.52 | nil |

WMO denotes White Mineral Oil; OS denotes Octylstearate

Table 2 identifies the VOC content of the individual dewatered emulsions in the upper portion of the table as well as the individual VOC content of the different continuous oil phases in the lower portion of the table.

The two-ply paper towel products produced as described above are tested before (initial) and after being subjected to the Accelerated and Stress Aging Procedures described herein.

Table 3 below summarizes the composition of the two-ply paper towel products from Table 2 above and the Control, which is void of any soil adsorbing polymer, and results of their Average Soil Adsorption Values (mg Soil Retained/g Article of Manufacture) as measured according to the Soil Adsorption Test Method described herein and the Average Mirror Densitometer Values as measured according to the Mirror Cleaning Test Method described herein, before (initial) and after being subjected to the Stress Aging Procedure (Week 0 (Initial), Week 2, Week 3) described herein and the Accelerated Aging Procedure (Week 0 (Initial) and Month 3) described herein.

TABLE 3

| Absorbent Substrate Description | | Average Soil Retention (mg/g) | | | | | Average Densitometer Mirror Cleaning | | | |
|---|---|---|---|---|---|---|---|---|---|---|
| | | Stress Aged | | | Accelerated Aged | | Stress Aged | | Accelerated Aged | |
| Dewatered Emulsion | Add-on Amount | 50° C./60% RH | | | 40° C./75% RH | | 50° C./60% RH | | 40° C./75% RH | |
| Lot Number | and Location | Initial | 2 week | 3 week | Initial | 3 month | Initial | 2 week | Initial | 3 month |
| Control | Not Applicable | 102 | 101 | 97 | 102 | 92 | −0.51 | −0.58 | −0.51 | −0.47 |
| ND823A | 0.9 #/ton single side | 206 | 154 | 135 | 206 | 143 | −0.15 | −0.17 | −0.15 | −0.2 |
| Hyperfloc ND823 | 0.9 #/ton single side | 214 | 168 | 157 | 214 | 159 | −0.13 | −0.19 | −0.13 | −0.21 |
| KY2438A1004 | 0.9 #/ton single side | 217 | 209 | 180 | 217 | 188 | −0.14 | −0.18 | −0.14 | −0.22 |
| KY2438B1004 | 0.9 #/ton single side | 219 | 204 | 201 | 219 | 178 | −0.18 | −0.16 | −0.18 | −0.33 |
| KY2438C1004 | 0.9 #/ton single side | 215 | 195 | 194 | 215 | 185 | −0.14 | −0.2 | −0.14 | −0.35 |
| KY2438D1004 | 0.9 #/ton single side | 194 | 177 | 190 | 194 | 191 | −0.22 | −0.2 | −0.22 | −0.3 |
| KY2438E1004 | 0.9 #/ton single side | 193 | 186 | 186 | 193 | 185 | −0.25 | −0.29 | −0.25 | −0.34 |
| KY2438F1004 | 0.9 #/ton single side | 215 | 196 | 184 | 215 | 189 | −0.28 | −0.3 | −0.28 | −0.38 |
| KY2438G1004 | 0.9 #/ton single side | 209 | 192 | 188 | 209 | 195 | −0.32 | −0.35 | −0.32 | −0.41 |
| KY2439A1001 | 0.9 #/ton single side | 209 | 148 | 135 | 209 | 135 | −0.13 | −0.15 | −0.13 | −0.31 |
| KY2439B1001 | 0.9 #/ton single side | 211 | 160 | 137 | 211 | 131 | −0.14 | −0.15 | −0.14 | −0.36 |
| KY2439C1001 | 0.9 #/ton single side | 218 | 164 | 148 | 218 | 147 | −0.14 | −0.13 | −0.14 | −0.33 |
| LC 3095 C | 0.9 #/ton single side | 213 | 189 | 173 | 213 | 193 | −0.15 | −0.14 | −0.15 | −0.27 |
| Hyperfloc AD859 | 1.8 #/ton dual side | 209 | 183 | 187 | 209 | 175 | −0.27 | −0.36 | −0.27 | −0.42 |
| Hyperfloc CD864 | 1.8 #/ton dual side | 224 | 206 | 210 | 224 | 182 | −0.34 | −0.2 | −0.34 | −0.44 |

Tables 4 and 5 below show the Average Soil Adsorption Values (mg Soil Retained/g Paper (Article of Manufacture)) as measured according to the Soil Adsorption Test Method described herein and the Average Mirror Densitometer Values as measured according to the Mirror Cleaning Test Method described herein, before (initial, week 0) and after being subjected to the Stress Aging Procedure (Week 0 (Initial), Week 2, Week 3) described herein and the Accelerated Aging Procedure (Week 0 (Initial) and Month 3) described herein obtained for the composition of the two-ply paper towel products of Table 2 above and the Control.

TABLE 4

| Soil Retention Data | | | | | | | | | | | | | | | | |
|---|---|---|---|---|---|---|---|---|---|---|---|---|---|---|---|---|
| | | Stress Aged at 50° C./60% RH | | | | | | | | | | | Accelerated Aged (40° C./75% RH) | | | |
| | Dewatered Emulsion | mg Soil Retn'd/ gram Paper | Avg. | St. Dev. | | mg Soil Retn'd/ gram Paper | Avg. | St. Dev. | | mg Soil Retn'd/ gram Paper | Avg. | St. Dev. | | mg Soil Retn'd/ gram Paper | Avg. | St. Dev. |
| Week 0 | ND823A | 203.9 | 205.8 | 2.3 | Week 2 | 156.4 | 153.7 | 3.0 | Week 3 | 138.1 | 134.8 | 3.4 | Month 3 | 151.0 | 142.6 | 7.5 |
| | | 208.3 | | | | 150.4 | | | | 134.9 | | | | 139.6 | | |
| | | 205.1 | | | | 154.3 | | | | 131.3 | | | | 137.0 | | |
| | Hyperfloc | 221.2 | 214.3 | 8.0 | | 166.0 | 167.8 | 2.4 | | 153.5 | 157.2 | 3.2 | | 155.4 | 158.9 | 4.4 |
| | ND823 | 216.1 | | | | 167.0 | | | | 159.2 | | | | 157.5 | | |
| | | 205.6 | | | | 170.5 | | | | 158.8 | | | | 163.8 | | |
| | KY2438 | 219.7 | 217.1 | 2.4 | | 208.0 | 208.5 | 0.8 | | 178.5 | 180.2 | 1.5 | | 192.0 | 188.1 | 3.4 |
| | A1004 | 216.8 | | | | 209.4 | | | | 181.4 | | | | 185.7 | | |
| | | 214.9 | | | | 208.2 | | | | 180.8 | | | | 186.5 | | |
| | KY2438 | 221.8 | 219.2 | 3.2 | | 197.5 | 203.5 | 5.6 | | 203.3 | 200.6 | 2.4 | | 175.5 | 177.6 | 4.0 |
| | B1004 | 220.2 | | | | 208.6 | | | | 198.9 | | | | 175.1 | | |
| | | 215.6 | | | | 204.4 | | | | 199.6 | | | | 182.3 | | |
| | KY2438 | 218.3 | 215.3 | 5.7 | | 193.1 | 194.9 | 2.1 | | 196.3 | 194.1 | 2.5 | | 187.9 | 184.6 | 7.2 |
| | C1004 | 219.0 | | | | 194.3 | | | | 194.4 | | | | 176.4 | | |
| | | 208.7 | | | | 197.2 | | | | 191.5 | | | | 189.6 | | |
| | KY2438 | 197.7 | 194.4 | 4.1 | | 170.0 | 177.1 | 6.3 | | 191.9 | 190.2 | 2.0 | | 192.6 | 190.6 | 6.4 |
| | D1004 | 189.8 | | | | 182.0 | | | | 187.9 | | | | 195.8 | | |
| | | 195.7 | | | | 179.2 | | | | 190.7 | | | | 183.4 | | |
| | KY2438 | 189.9 | 193.0 | 2.7 | | 190.5 | 186.3 | 10.1 | | 191.5 | 185.7 | 5.1 | | 183.0 | 184.6 | 1.8 |
| | E1004 | 194.4 | | | | 193.7 | | | | 183.7 | | | | 184.3 | | |
| | | 194.7 | | | | 174.8 | | | | 181.9 | | | | 186.6 | | |
| | KY2438 | 220.6 | 215.1 | 8.7 | | 200.4 | 196.2 | 5.2 | | 187.1 | 184.4 | 9.7 | | 191.2 | 188.6 | 2.4 |
| | F1004 | 219.6 | | | | 190.4 | | | | 173.6 | | | | 187.8 | | |
| | | 205.0 | | | | 198.0 | | | | 192.4 | | | | 186.7 | | |
| | KY2438 | 206.5 | 209.4 | 2.6 | | 189.8 | 192.2 | 4.9 | | 188.1 | 187.9 | 0.2 | | 194.5 | 194.7 | 6.6 |
| | G1004 | 211.7 | | | | 197.9 | | | | 187.8 | | | | 201.4 | | |
| | | 209.9 | | | | 189.0 | | | | | | | | 188.2 | | |
| | KY2439 | 213.2 | 208.5 | 5.1 | | 146.4 | 148.1 | 3.0 | | 132.1 | 135.2 | 2.8 | | 129.1 | 134.6 | 5.0 |
| | A1001 | 209.1 | | | | 151.6 | | | | 137.4 | | | | 136.1 | | |
| | | 203.1 | | | | 146.2 | | | | 136.0 | | | | 138.6 | | |

TABLE 4-continued

| Soil Retention Data | | | | | | | | | | | | | |
|---|---|---|---|---|---|---|---|---|---|---|---|---|---|
| | Stress Aged at 50° C./60% RH | | | | | | | | | Accelerated Aged (40° C./75% RH) | | |
| Dewatered Emulsion | mg Soil Retn'd/ gram Paper | Avg. | St. Dev. | mg Soil Retn'd/ gram Paper | Avg. | St. Dev. | mg Soil Retn'd/ gram Paper | Avg. | St. Dev. | mg Soil Retn'd/ gram Paper | Avg. | St. Dev. |
| KY2439 | 214.2 | 210.9 | 3.2 | 158.6 | 159.8 | 1.5 | 139.3 | 137.1 | 4.3 | 130.4 | 130.9 | 1.3 |
| B1001 | 207.8 | | | 161.4 | | | 132.1 | | | 132.4 | | |
| | 210.9 | | | 159.5 | | | 139.8 | | | 129.9 | | |
| KY2439 | 219.5 | 218.4 | 1.9 | 163.4 | 164.1 | 1.2 | 151.6 | 147.9 | 5.5 | 149.6 | 146.5 | 9.6 |
| C1001 | 219.4 | | | 165.5 | | | 141.5 | | | 154.3 | | |
| | 216.2 | | | 163.3 | | | 150.5 | | | 135.8 | | |
| LC3095 C | 210.3 | 212.7 | 3.1 | 190.0 | 188.7 | 1.6 | 167.0 | 172.6 | 5.3 | 197.1 | 192.7 | 4.0 |
| | 216.3 | | | 186.9 | | | 177.5 | | | 191.4 | | |
| | 211.5 | | | 189.1 | | | 173.2 | | | 189.5 | | |
| Hyperfloc | 214.2 | 209.4 | 4.8 | 181.5 | 182.7 | 3.3 | 189.6 | 186.6 | 2.7 | 169.7 | 174.8 | 4.7 |
| AD 859 | 209.5 | | | 180.2 | | | 184.4 | | | 175.7 | | |
| 1.8 # 2 | 204.6 | | | 186.4 | | | 185.7 | | | 178.9 | | |
| Side | | | | | | | | | | | | |
| Hyperfloc | 223.3 | 224.4 | 1.8 | 213.6 | 206.3 | 6.5 | 210.2 | 209.7 | 3.5 | 175.7 | 181.8 | 5.3 |
| CD 864 | 226.6 | | | 203.9 | | | 212.9 | | | 184.6 | | |
| 1.8 #/ton 2 | 223.4 | | | 201.3 | | | 205.9 | | | 185.2 | | |
| Side | | | | | | | | | | | | |
| Control | 104.2 | 102.0 | 2.0 | 96.2 | 100.5 | 4.8 | 91.8 | 97.1 | 4.9 | 95.0 | 92.2 | 2.7 |
| | 100.6 | | | 105.7 | | | 101.3 | | | 92.0 | | |
| | 101.1 | | | 99.5 | | | 98.1 | | | 89.6 | | |

TABLE 5

| Mirror Cleaning Data | | | | | | | | | | | |
|---|---|---|---|---|---|---|---|---|---|---|---|
| | | Photodensitometer Reading | | | | | Visual Grade | | | | |
| | | Mirror Number | | | | | Mirror Number | | | | |
| | Product Ref. | 1 | 2 | 3 | 4 | Avg | 1 | 2 | 3 | 4 | Avg |
| Week 0 | ND823A | 0.00 | −0.09 | −0.19 | −0.32 | −0.15 | 0.75 | 0.75 | 1.25 | 1.75 | 1.1 |
| | Hyperfloc ND823 | −0.09 | −0.09 | −0.14 | −0.20 | −0.13 | 0.75 | 1 | 1.25 | 1.25 | 1.1 |
| | KY2438 A1004 | −0.07 | −0.07 | −0.22 | −0.20 | −0.14 | 1 | 1 | 1.5 | 1.75 | 1.3 |
| | KY2438 B1004 | −0.02 | −0.12 | −0.26 | −0.30 | −0.18 | 0.5 | 1 | 1.75 | 1.75 | 1.3 |
| | KY2438 C1004 | −0.02 | −0.11 | −0.22 | −0.22 | −0.14 | 0.5 | 1.25 | 1.75 | 1.75 | 1.3 |
| | KY2438 D1004 | −0.05 | −0.13 | −0.28 | −0.41 | −0.22 | 0.5 | 1.25 | 1.75 | 2 | 1.4 |
| | KY2438 E1004 | −0.05 | −0.20 | −0.27 | −0.47 | −0.25 | 0.5 | 1.5 | 2 | 2.25 | 1.6 |
| | KY2438 F1004 | 0.00 | −0.22 | −0.39 | −0.51 | −0.28 | 0.75 | 1.5 | 2.25 | 2.5 | 1.8 |
| | KY2438 G1004 | −0.12 | −0.22 | −0.43 | −0.51 | −0.32 | 1 | 1.5 | 2.5 | 2.75 | 1.9 |
| | KY2439 A1001 | −0.10 | −0.14 | −0.09 | −0.19 | −0.13 | 1 | 1.25 | 1.25 | 1.5 | 1.3 |
| | KY2439 B1001 | −0.02 | −0.11 | −0.15 | −0.27 | −0.14 | 0.75 | 1.25 | 1.5 | 1.75 | 1.3 |
| | KY2439 C1001 | −0.03 | −0.12 | −0.22 | −0.19 | −0.14 | 0.75 | 1.25 | 1.75 | 1.5 | 1.3 |
| | LC3095 C | −0.02 | −0.11 | −0.21 | −0.29 | −0.15 | 0.5 | 1.5 | 1.75 | 2 | 1.4 |
| | Hyperfloc AD859 | −0.05 | −0.09 | −0.37 | −0.58 | −0.27 | 1 | 1.25 | 1.75 | 3 | 1.8 |
| | Hyperfloc CD864 | −0.04 | −0.12 | −0.23 | −0.18 | −0.14 | 0.75 | 1.25 | 1.5 | 1.5 | 1.3 |
| | Control | −0.43 | −0.28 | −0.47 | 0.85 | −0.51 | 2.25 | 1.75 | 2.75 | 3.25 | 2.5 |
| Week 2 | ND823A | −0.14 | −0.12 | −0.14 | −0.28 | −0.17 | 1.25 | 1 | 1.25 | 2 | 1.4 |
| Stress Aged | Hyperfloc ND823 | −0.17 | −0.12 | −0.18 | −0.27 | −0.19 | 1.5 | 0.75 | 1.5 | 1.75 | 1.4 |
| 50° C./60 | KY2438 A1004 | −0.14 | −0.07 | −0.23 | −0.29 | −0.18 | 1.25 | 1 | 1.5 | 1.5 | 1.3 |
| | KY2438 B1004 | −0.08 | −0.12 | −0.17 | −0.29 | −0.16 | 1 | 1.25 | 1.5 | 1.75 | 1.4 |
| | KY2438 C1004 | −0.05 | −0.09 | −0.27 | −0.41 | −0.20 | 1 | 1.25 | 1.5 | 1.75 | 1.4 |
| | KY2438 D1004 | −0.08 | −0.17 | −0.24 | −0.33 | −0.20 | 0.75 | 1.25 | 1.5 | 1.5 | 1.3 |
| | KY2438 E1004 | −0.06 | −0.15 | −0.36 | −0.58 | −0.29 | 0.5 | 1.25 | 1.5 | 2.25 | 1.4 |
| | KY2438 F1004 | −0.09 | −0.20 | −0.40 | −0.52 | −0.30 | 1 | 1.5 | 2 | 2.5 | 1.8 |
| | KY2438 G1004 | −0.07 | −0.20 | −0.52 | −0.62 | −0.35 | 0.75 | 1.25 | 2 | 2.5 | 1.6 |
| | KY2439 A1001 | −0.05 | −0.07 | −0.16 | −0.32 | −0.15 | 0.75 | 1.25 | 1.5 | 1.75 | 1.3 |
| | KY2439 B1001 | −0.08 | −0.11 | −0.11 | −0.28 | −0.15 | 1 | 1.25 | 1.25 | 1.5 | 1.3 |
| | KY2439 C1001 | −0.09 | −0.11 | −0.12 | −0.23 | −0.13 | 1 | 1 | 1.25 | 1.5 | 1.2 |
| | LC3095 C | −0.11 | −0.07 | −0.16 | −0.24 | −0.14 | 1 | 1 | 1.5 | 1.75 | 1.3 |
| | Hyperfloc AD859 | −0.23 | −0.22 | −0.33 | −0.68 | −0.36 | 1.25 | 1.5 | 2.5 | 3.25 | 2.1 |
| | Hyperfloc CD864 | −0.08 | −0.15 | −0.16 | −0.39 | −0.20 | 1.25 | 1.25 | 1.5 | 2 | 1.5 |
| | Control | −0.40 | −0.38 | −0.65 | −0.90 | −0.58 | 1.75 | 2.5 | 3.25 | 3.75 | 2.80 |

TABLE 5-continued

| Mirror Cleaning Data | | | | | | | | | | | |
|---|---|---|---|---|---|---|---|---|---|---|---|
| | | Photodensitometer Reading | | | | | Visual Grade | | | | |
| | | Mirror Number | | | | | Mirror Number | | | | |
| | Product Ref. | 1 | 2 | 3 | 4 | Avg | 1 | 2 | 3 | 4 | Avg |
| Month 3 | ND823A | −0.03 | −0.08 | −0.27 | −0.41 | −0.20 | 1.25 | 1.25 | 2.5 | 2.75 | 1.9 |
| Accelerated | Hyperfloc ND823 | −0.17 | −0.09 | −0.23 | −0.34 | −0.21 | 1.25 | 1.25 | 2.5 | 2.75 | 1.9 |
| Aged | KY2438 A1004 | −0.03 | −0.09 | −0.27 | −0.47 | −0.22 | 0.75 | 1.25 | 2.25 | 2.75 | 1.8 |
| 40° C./75% RH | KY2438 B1004 | −0.07 | −0.19 | −0.45 | −0.63 | −0.33 | 0.75 | 1.5 | 2.75 | 3.25 | 2.1 |
| | KY2438 C1004 | −0.03 | −0.19 | −0.48 | −0.70 | −0.35 | 1 | 1.25 | 2.75 | 3.25 | 2.1 |
| | KY2438 D1004 | −0.06 | −0.20 | −0.43 | −0.52 | −0.30 | 1 | 1.5 | 3 | 3.25 | 2.2 |
| | KY2438 E1004 | −0.10 | −0.16 | −0.46 | −0.62 | −0.34 | 0.75 | 2 | 2.75 | 3.25 | 2.2 |
| | KY2438 F1004 | −0.11 | −0.22 | −0.53 | −0.67 | −0.38 | 0.75 | 1.75 | 3 | 3.25 | 2.2 |
| | KY2438 G1004 | −0.09 | −0.21 | −0.52 | −0.82 | −0.41 | 0.75 | 2 | 3 | 3.25 | 2.3 |
| | KY2439 A1001 | −0.33 | −0.14 | −0.36 | −0.40 | −0.31 | 1.5 | 1.25 | 2.5 | 2.75 | 2.0 |
| | KY2439 B1001 | −0.15 | −0.21 | −0.44 | −0.61 | −0.36 | 1 | 1.5 | 2.75 | 3.5 | 2.2 |
| | KY2439 C1001 | −0.11 | −0.16 | −0.43 | −0.62 | −0.33 | 1 | 1.25 | 2.5 | 3.0 | 1.9 |
| | LC3095 C | −0.20 | −0.20 | −0.19 | −0.30 | −0.27 | 2.0 | 1.25 | 2.0 | 2.5 | 1.9 |
| | Hyperfloc AD859 | −0.26 | −0.22 | −0.46 | −0.74 | −0.42 | 1.5 | 1.5 | 3 | 3.25 | 2.3 |
| | Hyperfloc CD864 | −0.20 | −0.41 | −0.46 | −0.73 | −0.44 | 1.5 | 1.5 | 3.0 | 3.5 | 2.4 |
| | Control | −0.26 | −0.25 | −0.55 | −0.82 | −0.47 | 1.75 | 1.75 | 3 | 3.5 | 2.5 |

Test Methods

Unless otherwise specified, all tests described herein including those described under the Definitions section and the following test methods are conducted on samples that have been conditioned in a conditioned room (CTCH room) at a temperature of 23° C.±1.0° C. and a relative humidity of 50%±2% for a minimum of 2 hours prior to the test. All plastic and paper board packaging articles of manufacture must be carefully removed from the paper samples prior to testing. The samples tested are "usable units." "Usable units" as used herein means sheets, flats from roll stock, pre-converted flats, and/or single or multi-ply products. Except where noted all tests are conducted in such conditioned room, all tests are conducted under the same environmental conditions and in such conditioned room. Any damaged product is discarded. Test samples with defects such as wrinkles, tears, holes, and like are not measured. Samples conditioned as described herein are considered dry samples (such as "dry filaments") for testing purposes. All instruments are calibrated according to manufacturer's specifications.

Accelerated and Stress Aging Procedures

Finished Product stability is defined as the ability of the Finished Product to deliver its intended performance after subjection to the normal range of storage, delivery, and retail conditions. Finished product rolls were packaged using 0.6 mil low density polyethylene film (a proprietary film, Extrel EX1560 available from Tredegar Corporation for this limited purpose) following the procedure detailed below:

1. Cut a 2×3 ft section of 0.6 mil low density polyethylene film.
2. Lay two finished product rolls of paper towels on poly film about 4 inches from the edge of the film such that the rolls are aligned with the 3 ft dimension, and fold poly along the length of the poly over top of the length of the rolls.
3. Heat seal the fold using 3 parallel seals ⅓ inch between each parallel line to insure an effective seal along the length of the rolls.
4. Heat seal on one end about an inch from the end of the poly. This forms a "sock" around the two rolls.
5. Taking care to minimize the volume of air that remains within the finished package, heat seal the final end an inch from the final edge of the 3 ft length of poly forming an airtight seal around the rolls.

The relatively long tail on the package permits samples to be taken off the rolls for testing, resealed and returned to the CTCH room for additional aging. Accelerated and Stress aging conditions are as follows:

Accelerated Aging (40° C.+/−2°, 75% RH+/−5% for 3 months);

Stress Aging (50° C.+/−2°, 60% RH+/−5% for 2 weeks, optionally extended to 3 weeks);

Samples are taken for testing by removing the package from the CTCH room, cutting the end of the package near as possible to the heat seal, remove the rolls, remove 2 sheets from the outside of the rolls and discard, remove 4 full size sheets for mirror cleaning testing and 1 additional sheet for soil retention. Place rolls back into package, and heat seal the top where it was cut and place back into CTCH room for additional aging if necessary. Product aging without packaging under ambient lab conditions (23° C.±1.0° C. and a relative humidity of 50%±2%) has been shown to not occur, therefore test sheets removed from the high CTCH room can be stored under ambient lab conditions without undergoing additional aging before testing.

UL Viscosity Test Method

1) Reagents and Equipment
   a) NaCl,
   b) Deionized water,
   c) 9 moles Ethoxylated Nonyl Phenol (for example SYNPERONIC NP9 from ICI surfactant),
   d) Mechanical stirrer fitted with a stainless steel shaft equipped at the end with about 2 cm radius propeller-type blades,
   e) High tall 600 ml beaker,
   f) Disposable syringes (5 ml, 2 ml and 10 ml)
   g) Balance with an accuracy of 0.001 g,
   h) Thermometer,
   i) 200 μm stainless steel screen.
2) Preparation of an initial 0.5% polymer solution in water
   a) Obtain a clean 600 ml beaker and fill it with 100 g of deionized water,
   b) Start stirring with the mechanical stirrer at 500 rpm to create a vortex, c) Calculate the weight of pure emulsion ($W_0$) required to obtain 0.5 g of polymer, $$W_0=50/C$$

C is the percentage of active matter in the emulsion d) Withdraw approximately the weight ($W_0$) of emulsion into a plastic syringe, e) Weigh accurately the syringe and record the weight filled ($W_F$), f) Disperse rapidly the contents of the syringe into the vortex of the beaker, g) Let stir 30 minutes, h) Weigh the empty syringe and record the weight empty ($W_E$), i) Calculate $W=W_F-W_E$.

3) Preparation of a 0.1% solution of polymer in 1 M NaCl a) Remove the beaker from the stirrer let the shaft and the blade, drain completely over the beaker, b) Place the beaker on the balance and weigh in accurately:

i) 0.2 g of ethoxylated nonyl phenol ii) ($Q_E$) g of deionized water, where $Q_E=W\times(9.7949\times C-1)-100.2$, c) Let it stir again for 5 minutes at 500 rpm, d) Then add the salt $Q_S$ in g: let if stir for 5 minutes, where $Q_S=0.585\times W\times C$, e) Resulting in a 0.1% solution of polymer in 1 M NaCl, f) The polymer solution is now ready for measurement after filtration through a 200 μm screen.

4) In the Case of a High Molecular Weight Emulsion (UL Viscosity greater than 7cP)

a) Prepare the solution at 0.5% as in step 2.

b) Remove the beaker from the stirrer let the shaft and the blade drain completely over the beaker, c) Place the beaker on the balance and weight accurately:

i) 0.2 g of ethoxylated nonyl phenol, ii) ($Q_E$) g of deionized water where $Q_E=W\times(9.7949\times C-1)-100.2$, d) Let it stir again for 5 minutes at 850 rpm, e) Then add the salt $Q_S$ in g; let it stir for 5 minutes at 850 rpm, where $Q_S=0.585\times W\times C$ f) Resulting in a 0.1% solution of polymer in 1 M NaCl, g) The polymer solution is now ready for viscosity measurement after filtration through a 200 μm screen.

5) Viscosity Measurement of Polymer Solution

The viscosity is determined by means of a Brookfield viscometer model LVT with the UL adapter and a spindle speed of 60 rpm a) 16 ml of the solution are placed in the cup, and the temperature is adjusted to 23-25° C. the cup is then attached to the viscometer.

b) Let the spindle turn at 60 rpm until the reading is stable on the dial (about 30 seconds);

c) Read the value indicated on the dial:

$$\text{Viscosity(in cP)}=(\text{reading}-0.4)\times 0.1$$

Basis Weight Test Method

Basis weight of a fibrous structure, such as sanitary tissue product, is measured on stacks of twelve usable units using a top loading analytical balance with a resolution of ±0.001 g. The balance is protected from air drafts and other disturbances using a draft shield. A precision cutting die, measuring 3.500 in±0.0035 in by 3.500 in±0.0035 in is used to prepare all samples.

With a precision cutting die, cut the samples into squares. Combine the cut squares to form a stack twelve samples thick. Measure the mass of the sample stack and record the result to the nearest 0.001 g.

The Basis Weight is calculated in lbs/3000 $ft^2$ or $g/m^2$ as follows:

$$\text{Basis Weight}=(\text{Mass of stack})/[(\text{Area of 1 square in stack})\times(\text{No. of squares in stack})]$$

For example, $$\text{Basis Weight(lbs/3000 ft}^2)=[[\text{Mass of stack(g)}/453.6\ (\text{g/lbs})]/[12.25(\text{in}^2)/144(\text{in}^2/\text{ft}^2)\times 12]]\times 3000$$

or, $$\text{Basis Weight(g/m}^2)=\text{Mass of stack(g)}/[79.032(\text{cm}^2)/10{,}000(\text{cm}^2/\text{m}^2)\times 12]$$

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

Moisture Content Test Method

The moisture content present in an article of manufacture, such as a fibrous structure is measured using the following Moisture Content Test Method. An article of manufacture or portion thereof ("sample") is placed in a conditioned room at a temperature of 23° C.±1.0° C. and a relative humidity of 50%±2% for at least 24 hours prior to testing. Each fibrous structure sample has an area of at least 4 square inches, but small enough in size to fit appropriately on the balance weighing plate. Under the temperature and humidity conditions mentioned above, using a balance with at least four decimal places, the weight of the sample is recorded every five minutes until a change of less than 0.5% of previous weight is detected during a 10 minute period. The final weight is recorded as the "equilibrium weight". Within 10 minutes, the sample is placed into a forced air oven on top of foil for 24 hours at 70° C.±2° C. at a relative humidity of 4%±2% for drying. After the 24 hours of drying, the sample is removed and weighed within 15 seconds. This weight is designated as the "dry weight" of the sample.

The moisture content of the sample is calculated as follows:

$$\%\ \text{Moisture in sample} = 100\% \times \frac{(\text{Equilibrium weight of sample} - \text{Dry weight of sample})}{\text{Dry weight of sample}}$$

The % Moisture in sample for 3 replicates is averaged to give the reported % Moisture in sample. Report results to the nearest 0.1%.

Soil Adsorption Test Method

In order to measure an article of manufacture's Average Soil Adsorption Value the following test is conducted.

Preparation:

A specimen of the article of manufacture, such as a fibrous structure, to be tested is obtained from the central portion of a representative sample of the article of manufacture. The specimen is prepared by cutting a CD strip (extending across the entire CD of the article of manufacture) from an article of manufacture, such as a finished fibrous structure and/or sanitary tissue product sheet (sample) such that the cut CD strip specimen has a length and width resulting in the specimen weighing 0.65 g±0.02 g. The sheet of the sample from which the CD strip specimen is cut may be delineated and connected to adjacent sheets by perforation or tear lines or the sheets of the sample may be individual sheets, such as in the form of individual wipes and/or facial tissues. If connected via perforation or tear lines, then separate one sheet from any adjacent sheet before cutting the CD strip from the sheet. The CD strip specimen needs to be free of perforations and is obtained from a portion of an article of manufacture at least 0.5 inches from any perforations. The specimen is conditioned as described above. The sample weight ($W_{Prod}$) is recorded to the within ±0.0001 g. A suitable ball-point pen or equivalent marker is used to write the specimen name onto a corner of the specimen.

A centrifuge tube (VWR brand 50 mL superclear ultra high performance freestanding centrifuge tube with flat caps, VWR Catalog #82018-052; or equivalent tube) is labeled with the specimen name and weighed to within ±0.1 mg $W_{CT}$. Next, 155.0 mg±5.0 mg of a model soil (black todd clay) available from Empirical Manufacturing Co., 7616 Reinhold Drive, Cincinnati, Ohio 45237-3208) is placed into the centrifuge tube. The tube is re-weighed $W_{(CT+Soil)}$ and the model soil weight ($W_{Soil}$) is determined to nearest 0.2 mg by difference $W_{(CT+Soil)}-W_{CT}$.

Distilled water, 35 g±0.5 g is added slowly to the centrifuge tube using a suitable dispenser. The centrifuge tube is a VWR brand 50 mL superclear ultra high performance freestanding centrifuge tube with flat caps (VWR Catalog #82018-052, or equivalent tube). The distilled water is poured carefully into the centrifuge tube to avoid causing a plume of dust from the model soil. If a plume of dust occurs such that the weight of soil in the tube may be impacted, the tube is discarded and a new tube is prepared. The tube is then re-weighed $W_{(CT+Soil+Water)}$ and the total weight ($W_{(Soil\ Dispersion)}$ of water plus soil in the centrifuge tube is calculated by subtracting the weight of the centrifuge tube $W_{CT}$ from the $W_{(CT+Soil+Water)}$ and recorded to the nearest 0.2 mg.

A glass petri dish (e.g. VWR 50×35, VWR Catalog #89000-280, or equivalent dish) is labeled and weighed to within 0.1 mg ($W_{(Petri\ Dish)}$).

Testing:

A reciprocating shaker is used to disperse the model soil in the water. The model soil must be completely dispersed for the results to be valid. A reciprocating shaker (IKA Works HS 501 digital reciprocating shaker, number 2527001, with a Universal attachment, number 8000200, or equivalent shaker) is set to 300±3 cycles per minute. The capped centrifuge tube containing the model soil and water is mounted in the shaker and shaken for 30 seconds to obtain a uniform dispersion of the soil in the water (soil dispersion).

The specimen is loosely folded along its transverse centerline with an accordion style (paper fan) folding technique. The specimen is loosely folded 5 times, to produce a sample that contains 10 segments each about 2.5 cm in length. This folding technique keeps the sample from being too tightly folded, which may hinder free flow of water and suspended soil over all surfaces of the article the thus efficiency of the paper to adsorb the soil. The folded sample is fully immersed into the soil dispersion in the centrifuge tube so that the folds run parallel to the length of the centrifuge tube. The tube is immediately re-capped and shaken in the reciprocating shaker for 30+/−1 seconds with the length axis of the centrifuge tube parallel to the motion of the reciprocating shaker.

After shaking, the folded specimen is carefully removed over the glass petri dish using laboratory tweezers. Care must be taken to ensure that greater than 95% of the soil dispersion is kept either in the original centrifuge tube or corresponding glass petri dish. The soil dispersion is wrung (removed) from the specimen using a "wringing" motion and collected in the glass petri dish. Once the soil dispersion has been removed from the specimen, the specimen is discarded. The remaining soil dispersion is poured from the centrifuge tube into the glass petri dish after swirling the mixture to re-disperse model soil into water, thereby ensuring that no model soil is inadvertently left behind in the centrifuge tube. The glass petri dish containing the model soil/water mixture is weighed to within ±0.1 mg $W_{(Petri\ Dish+Soil\ Dispersion)}$. The weight of soil dispersion recovered $W_{(Recovered\ Soil\ Dispersion)}$ is calculated by subtracting the weight of the glass petri dish $W_{(Petri\ Dish)}$ from the $W_{(Petri\ Dish+Soil\ Dispersion)}$. The glass petri dish is then placed into a vented laboratory drying oven at 105° C. until the sample is residual soil is fully dry. The $W_{(Recovered\ Soil\ Dispersion)}$ should be >95% of the $W_{(Soil\ Dispersion)}$. Once the sample is dry, the glass petri dish containing the dried model soil is removed from the oven and placed in a desiccator until cool and then re-weighed to within ±0.1 mg $W_{(Petri\ Dish+Residual\ Dry\ Soil)}$. The weight of residual soil $W_{(Residual\ Soil)}$ is calculated by subtracting the weight of the glass petri dish $W_{(Petri\ Dish)}$ from $W_{(Petri\ Dish+Residual\ Dry\ Soil)}$ and recorded to the nearest 0.2 mg.

Calculations:

To calculate the amount of residual model soil $W_{(Residual\ Soil)}$ left in the glass petri dish, the following equation is used:

$$W_{(Residual\ Soil)}=W_{(Petri\ Dish+Residual\ Dry\ Soil)}-W_{(Petri\ Dish)}$$

Residual model soil weight (W \ (Residual Soil)) is reported in mg.

To calculate the amount of normalized residual model soil ($W_{(Norm\ Residual\ Soil)}$) left in the glass petri dish, the following equation is used:

$$W_{(Norm\ Residual\ Soil)}=W_{(Residual\ Soil)}*W_{(Soil\ Dispersion)}/W_{(Recovered\ Soil\ Dispersion)}$$

Normalized residual soil weight $W_{(Norm\ Residual\ Soil)}$ is reported in mg.

To calculate the amount of soil adsorbed by the sample, the following calculation is used:

$$W_{(Soil\ Adsorbed)}=(W_{(Soil)}-W_{(Norm\ Residual\ Soil)})/W_{(Prod)}$$

Soil adsorbed in sample $W_{(Soil\ Adsorbed)}$ is reported as mg soil/g article of manufacture.

The test is performed on three replicates and an Average Soil Adsorption Value (Avg $W_{(Soil\ Adsorbed)}$) is calculated for the article of manufacture. These values are measured and calculated for initial Average Soil Adsorption Value of a specimen prior to subjecting the specimen to the Accelerated and Stress Aging Procedures described herein and after subjecting the specimen to the Accelerated and Stress Aging Procedures described herein. Soil Adsorption Value is also referred to herein as mg Soil Retained/gram Paper and its corresponding % Soil Retained (by Paper).

Mirror Cleaning Test Method

A test stand cart holding 4 individual 28"×28" mirrors (one on each of the 4 sides) resting on a flat surface, such as a floor, is utilized for the mirror cleaning test. The silver mirror layer is on the back surface of a flat clear glass sheet approximately 5 mm thick. The cart is configured such that the bottom edge of each mirror is approximately 3' 6" off the flat surface.

The mirror is prepared for testing by cleaning as follows: 1) Windex® commercially available from SC Johnson (an alkaline composition (pH>9) containing 0.1-1.0% by weight of Ethyleneglycol Monohexylether, 1.0-5.0% by weight of Isopropanol, 0.1% sodium lauryl sulfate, 0.05-28% ammonia, and 90-100% by weight of Water) or equivalent is sprayed (4 full sprays, about 3.5 g of solution) onto the mirror surface which is then spread across the entire surface of the mirror with 2 sheets of a 1-ply paper towel, for example 2010 commercially available Bounty® Basic (folded into quarters) using a circular wiping motion; 2) the mirror surface is then wiped dry and lightly polished with the essentially dry side of the folded 1-ply paper towel; 3) wiping the mirror surface with an additional two sheets of the 1-ply paper towel saturated with deionized water; and 4) using a squeegee in a top to bottom motion to remove all excess deionized water. Steps 3) & 4) may be repeated as necessary to achieve a streak and smudge free mirror surface that has no residual impact on the cleaning performance of subsequent test articles of manufacture. Any suitable absorbent substrate can be used in place of Bounty Basic that is not impregnated with polymers that may be deposited onto the glass surface, which may impact the ease or difficulty of cleaning with subsequent test article of manufacture.

A model soil suspension is prepared by suspending 1% by weight of Black Todd Clay in a 50/50 weight ratio of water/isopropyl alcohol mixture containing 0.05% by weight of 100% soybean oil (viscosity of from 150 cP to 200 cP).

Preparation of 100% cooked soybean oil is as follows. Approximately 200 grams of 100% soybean oil available from Spectrum Chemical Manufacturing Corp., 14422 S. San Pedro St., Gardena, Calif. 90248 is placed in a 1000 mL beaker with stir bar. The soybean oil in the beaker is placed on a hot plate and heated to 204° C. while stirring slowly. Air is added through a glass pipette tip set to bubble continuously through the oil without splashing. The oil is cooked continuously until viscosity, at 25° C.±2.2° C., is between 150 and 200 cP. The color changes to a dark orange. Viscosity is measured using a Cannon-Ubbelohde Viscometer tube #350 available from Cannon Instrument Company, State College, Pa. 16803, or equivalent viscometer. A sample of oil which is near room temperature is added to the viscometer and equilibrated to 25° C. in a constant temperature water bath. The efflux time for the meniscus to pass from the top mark to the bottom mark is measured to within ±0.01 second while allowing the oil to flow through the viscometer tube under gravity. Kinematic viscosity in $mm^2/s$ is calculated by multiplying the time in seconds by the calibration constant supplied with the viscometer tube. Separately the fluid density is determined by measuring the weight of a fixed volume of oil using a 25 mL volumetric flask and a 4 place analytical balance. Viscosity in cP can be calculated by multiplying the Kinematic viscosity by density of oil in g/mL. The cooking time will vary depending on quantity, surface area and air flow through the oil.

The following procedure is used to apply model soil to the clean mirror surfaces. The target amount of model soil sprayed is 44 g+/−2.5 g. A spray bottle, part #0245-01 available from www.SKS-bottle.com or equivalent spray bottle is used to spray the model soil suspension onto the mirror surface. Fill the spray bottle to within about 0.5 to 1 inch of the top with the model soil suspension and weigh to the nearest 0.01 g and record as initial weight. The spray bottle is then manually pressurized as needed to achieve a dispersed spray of fine droplets (about 30 full pumps is recommended). Additional pressurization is required between each mirror (about 10 pumps is recommended). Holding the spray bottle about 1.5 feet from the mirror surface a substantially horizontal sweeping motion is used starting at the top of the mirror surface and working down to the bottom of the mirror surface traversing the mirror surface a total of 8 times while attempting to have relatively even coverage on the mirror surface. After applying the model soil suspension to all 4 mirrors, the spray bottle and remaining contents are weighed to the nearest 0.01 g and recorded as weight after first spray. The mirrors are dried sequentially using a handheld hair dryer. The difference between the initial weight and after first spray is used to adjust the amount of spray applied in a second application to achieve the target amount of 44 g+/−2.5 g. The second application of the model soil suspension is applied to each mirror surface in a circular motion, moving from the outside (approximately 8-10 inches from the side edges) inward toward the center. After drying the second application of model soil suspension the mirrors are ready to be cleaned with an article of manufacture ("specimen") to be tested. If the time between soil application and cleaning of the mirrors with a test sample extends past 30 minutes, the mirrors need to be returned to their pristine condition using the procedure defined previously after which the soil application procedure can be repeated.

A specimen of a test article of manufacture, for example a paper towel, is prepared as follows. Two sheets of the article of manufacture, for example a paper towel, may be delineated and connected to adjacent sheets by perforation or tear lines or the sheets of the sample may be individual sheets, such as in the form of individual wipes, napkins, and/or facial tissues. If the article of manufacture, for example a paper towel, is a select-a-size format, then 4 sheets are used. Individual sheet dimensions or in the case of select-a-size two sheets vary by brand from about 8.5"×11" to 14"×11" and 2.20 g to 5.2 g. The 2 or for select-a-size 4 sheet specimen is folded in half as shown in FIG. 1 (along perforations if present) with the emboss side out (where applicable). As shown in FIG. 1, the folded sample is then folded in half again with the crease perpendicular to the MD direction and then folded in half again perpendicular to the CD direction such that a sample pad of quarter size sheet that is 8 sheets thick is formed, each sheet may consist of 1, 2 or more individual plies. In the case of articles of manufacture with single side application of soil attracting polymer it is important to fold the sheet such that the side containing the soil attracting polymer directly contacts the surface of the mirror. The mirror surface is then treated with 5 full sprays of Windex: two at top; one in the center and two in the lower area of the mirror. The weight of Windex sprayed per mirror is about 4.35 g±0.36 g. The mirror surface is cleaned by grasping the sample pad in the hand, clamping the substrate between the thumb and index finger and wiping with firm pressure in a cross direction, while holding the sheet (side 1) as flat as possible upon the surface of the mirror and avoiding contacting the mirror with any part of the hand using 8 side-to-side passes, such that the full surface of the mirror is contacted. The sample pad is then turned over and the relatively dry back-side (side 2) is used to wipe the mirror surface in an up and down motion, with firm pressure applied using 14 passes, ensuring that the entire surface of the mirror is contacted, again holding the sample pad as flat against the mirror surface as possible. The sample pad is then unfolded once and then folded back on itself revealing a relatively fresh sample pad surfaces to clean the second mirror after application of Windex as discussed above; side 3 (opposite side 1) is used for the side-to-side wiping and then turned over to side 4 (opposite side 2) for the up and down wiping. The pad is then unfolded twice to reveal a fresh surface of the specimen. The specimen is then folded in half such that the fresh sample surface is visible with the two used areas of the first sample pad configuration (sides 1 and 3) facing each other and then folded again to clean the third mirror surface after application of Windex as discussed above. Side 5 opposite side 1 and 3 is used first and then turned over to side 6 for the second up and down wiping. The sample pad is unfolded once and then folded back on itself revealing sides 7 and 8 to clean the fourth mirror surface after application of Windex as discussed above. Side 7 opposite sides 5, 3 & 1 is used for the side-to-side wiping and then turned over to side 8 for the final up and down wiping. In each case the wettest part of the folded sample pad is used for the side-to-side wiping and the dryer side for the final up and down wiping.

All 4 mirror surfaces should be cleaned sequentially such that minimal drying of the specimen pad occurs. After cleaning all four mirror surfaces, the mirror surface is permitted to dry and each mirror surface's optical density is measured utilizing an X-Rite 518 Spectrodensitometer. A full calibration as described in the operator's manual is performed. The instrument is set-up per instructions in the manual in Density minus Reference Measurement Mode. The four 28"×28" mirror surfaces were cleaned as described above representing a pristine condition. A single reading of a mirror in pristine condition is completed and stored as Ref1 and is used as a reference for all subsequent measurements. A series of 9, 12, or 15 measurements are made on each of the 4 mirrors (3, 4, or 5, respectively, across the top, 3, 4, or 5, respectively, across the middle and 3, 4, or 5, respectively, across the bottom always maintaining a minimum of 3 inches from any edge of the mirror) as shown in FIG. 2 for example. The mirror cleaning test stand is oriented in the lab such that there is no direct overhead lighting and rotated such that the mirror being measured is facing towards an interior wall thus minimizing any influence caused by external lighting differences. Measurements were performed on each of the pristine mirrors. These 9, 12, or 15 individual values are averaged for each mirror. The average values were found to be consistent between mirrors, however, as expected the average shows a small difference from the single point reference. This difference is used to correct all subsequent average values measured. Additionally, average values were determined for mirrors after application of the model soils. After, following the cleaning procedure with the sample specimen, 9, 12, or 15 density readings are performed and an average Densitometer Value is reported for each of the individual mirrors. The Average Mirror Cleaning Densitometer Value is the average of the average Densitometer Values across all 4 mirrors. The orientation of the mirrors and room lighting is such that streaks are not readily visible thus insuring a random location of each measurement taken within the limitations of the 3×3, 3×4, or 3×5 grid described above.

Volatile Organic Carbon (VOC) Test Method

The VOC content of an article of manufacture, expressed in units of weight of VOC per weight of polymer (soil adsorbing agent(s)), and shall be determined as follows. The VOC content of water in oil emulsions and dewatered emulsions is determined utilizing EPA method 24. Specifically the following procedure was utilized:

% volatiles:

1. Weigh a dry aluminum drying pan utilizing a 4 place analytical balance.
2. Equilibrate sample by gently mixing to insure representative sampling.
3. Add approximately 1 gram of neat material (sample) to the pre-weighed aluminum drying pan and weigh on the 4 place analytical balance.
4. Weight in step 3 minus the weight in step 1 equals the sample weight.
5. Place aluminum drying pan with sample into oven at 105° C. for 1 hour.
6. Remove the aluminum drying pan and dry sample from oven and place in a dessicator to cool.
7. Reweigh aluminum drying pan+dried and cooled sample on 4 place analytical balance.
8. Difference in weight of step 7 minus step 1 equals the residual weight.
9. Residual weight determined in step 8 divided by the sample weight in step 4×100=% solids at 105° C.
10. 100 minus % solids determined in step 9 equals % volatile at 105° C. % moisture by Karl Fischer:

The industry standard volumetric titration using a Metler DL18 or DL31 Karl Fischer specific titrator, a two component reagent system and a Mettler DM143-SC double platinum pin electrode. Alternatively, moisture can be determined by ASTM D 4017.

% VOC:

$$VOC = \%\ Volatiles - \%\ Moisture.$$

Charge Density Test Method

If one has identified or knows the soil adsorbing agent in and/or on an article of manufacture, then the charge density of the soil adsorbing agent can be determined by using a Mutek PCD-04 Particle Charge Detector available from BTG, or equivalent instrument. The following guidelines provided by BTG are used. Clearly, manufacturers of articles of manufacture comprising soil adsorbing agents know what soil adsorbing agent(s) are being included in their articles of manufacture. Therefore, such manufacturers and/or suppliers of the soil adsorbing agents used in the articles of manufacture can determine the charge density of the soil adsorbing agent.

1. Start with a 0.1% solution (0.1 g soil adsorbing agent+99.9 g deionized water). Preparation of dilute aqueous solutions in deionized water from inverse or dewatered inverse emulsions are performed as instructed by the supplier of the emulsions and is well known to one of ordinary skill in the art. Depending on the titrant consumption increase or decrease soil adsorbing agent content. Solution pH is adjusted prior to final dilution as charge density of many additives is dependent upon solution pH. A pH of 4.5 is used here for cationic polymers and between 6-7 for anionic polymers. No pH adjustment was necessary for the anionic polymers included in this study.

2. Place 20 mL of sample in the PCD measuring cell and insert piston.

3. Put the measuring cell with piston and sample in the PCD, the electrodes are facing the rear. Slide the cell along the guide until it touches the rear.

4. Pull piston upwards and turn it counter-clock-wise to lock the piston in place.

5. Switch on the motor. The streaming potential is shown on the touch panel. Wait 2 minutes until the signal is stable.

6. Use an oppositely charged titrant (for example for a cationic sample having a positive streaming potential: use an anionic titrant). Titrants are available from BTG consisting of 0.001N PVSK or 0.001N PolyDADMAC.

7. An automatic titrator available from BTG is utilized. After selecting the proper titrant, set the titrator to rinse the tubing by dispensing 10 mL insuring that all air bubbles have been purged.

8. Place tubing tip below the surface of the sample and start titration. The automatic titrator is set to stop automatically when the potential reaches 0 mV.

9. Record consumption of titrant, ideally, the consumption of titrant should be 0.2 mL to 10 mL; otherwise decrease or increase soil adsorbing agent content.

10. Repeat titration of a second 20 mL aliquot of the soil adsorbing agent sample.

11. Calculate charge demand (solution) or charge demand (solids);

$$\text{Charge demand } (eq/L) = \frac{V \text{ titrant used}(L) \times Conc. \text{ of titrant in Normality } (eq/L)}{\text{Volume of sample titrated } (L)}$$

$$\text{Charge demand } (eq/g) = \frac{V \text{ titrant used}(L) \times Conc. \text{ of titrant in Normality } (eq/L)}{\text{Wt. solids of the sample or its active substance (g)}}$$

The charge density (charge demand) of a soil adsorbing agent is reported in meq/g units.

Acrylamide Monomer Test Method:

Acrylamide is prepared for analysis from an article of manufacture by extracting 1 gram of the article with 20 mL of Analytical Reagent Grade Water (ARW). The analyte and internal standard ($^{13}C_3$-acrylamide) are subjected to reversed-phase high performance chromatographic (RP-HPLC) analysis on a Phenomenex Synergi Hydro-RP column (2.1×150 mm, 4 μm, 80 Å). Detection and quantification is by tandem mass spectrometry (MS/MS) operating under multiple reaction monitoring (MRM) conditions. Calibration standards (STD) prepared in ARW are used to quantitate Quality Control (QC) samples and unknown specimens. The nominal range of quantitation is 0.5 to 100 ng/mL. The assay requires a 0.2 mL aliquot of ARW extract of article. Specimen concentrations are determined by back-calculation using a weighted ($1/x^2$) quadratic calibration curve generated from neat STDs.

Reagents:

1. Acrylamide. Sigma-Aldrich,
2. $^{13}C_3$-Acrylamide. Isotec.
3. Methanol (MeOH). EMD, HPLC grade, cat #MX0475P-1; or equivalent.
4. Acetonitrile (ACN). EMD, HPLC grade, cat #AX0145; or equivalent.
5. Formic Acid. EMD, cat #11670; or equivalent.
6. Analytical Reagent Grade Water (ARW); or equivalent.
7. Needle Wash 1: ARW with 0.1% FA. Expires after 3 months stored at room temperature. (Example: Combine 1000 mL of ARW with 1 mL formic acid.)
8. Needle Wash 2: ACN with 0.1% FA. Expires after 6 months stored at room temperature. (Example: Combine 1000 mL of acetonitrile with 1 mL formic acid.)
9. Mobile Phase A: 4% MeOH/96% ARW (v/v) with 0.1% FA. Expires after 3 months stored at room temperature. (Example: Combine 960 mL of ARW and 40 mL of MeOH with 1 mL formic acid.)
10. Mobile Phase B: 95% MeOH/5% ARW (v/v) with 0.1% FA. Expires after 3 months stored at room temperature. (Example: Combine 950 mL of MeOH and 50 mL of ARW with 1 mL formic acid.)

Apparatus:

1. Electronic Dispensing Pipettes (EDP), manual pipettes; or equivalent.
2. HPLC pump. Shimadzu Model SCL-10A vp system controller & LC-10AD vp pumps with Gilson Model 811C mixer (65 μL volume); or equivalent.
3. Mass spectrometer. Sciex API 4000; or instrument meeting equivalent sensitivity requirements using analyst software.
4. Valco Two Position Actuator; or equivalent.
5. Analytical Column. Phenomenex Synergi Hydro-RP column (2.0×150 mm, 4 μm, 80 A).
6. 20 mL Scintillation Vials, Wheaton, catalog #986541; or equivalent.
7. 50 mL polypropylene centrifuge tube.
8. Multi-Tube Vortexer. VWR brand; or equivalent.
9. Autosampler. CTC Analytics HTS PAL, Leap Technologies; or equivalent.
10. 1.3 mL Round Well Round Bottom Polypropylene 96-well Injection Plates. Microliter cat #07-3000, VWR cat #100532-120; or equivalent.
11. 1.3 mL Sealing Mat for Deep 96 Round Well Collection Plates. Axygen Scientific cat #AM-750UL-RD; or equivalent.

Procedure:

1. Preparation of Acrylamide Calibration Standards (STD) and Quality Control (QC) Samples Separate Stock solutions should be prepared for STD and QC samples to verify correctness of weighing. Standards and QC samples are prepared fresh daily.

1.1. Acrylamide Standard Stock (STD Stock) and QC Stock (QC Stock) Solutions (1.00 mg/mL):

Prepare separate two 1.00 mg/mL stocks of the compound, one for standards (STD Stock) and the other for QCs (QC Stock).

Typical Preparation: Using the appropriate Analytical Reference Standard weigh approximately 5-20 mg into a Scintillation Vial and record the weight. Add calculated volume of water determined in Equation 1 to the vial. An ultrasonic cleaner may be used to assist dissolving the compound. Mix well and store at room temperature (about 23.0° C.). The stability is to be determined.

$$\text{Volume to add (ml)} = \frac{\text{Mass of material (mg)}}{\text{1.00 mg/mL concentration}} \times \text{\% Purity} \qquad \text{Equation 1}$$

Where: Purity=Decimal % purity assigned to the Analytical Reference Standard multiplied by any salt correction factor.

1.2. Standard (STD) Solutions and QC Solutions:

With an adjustable volume pipette, add the appropriate amount of each Spiking Solutions, according to Table 6 into an appropriate scintillation vials to make the indicated ng/mL STD or QC solutions. For makeup solution, dilute using water. Mix well and store at room temperature until use.

Preparation of Calibration Standard Curve and QC Samples.

TABLE 6

| Solution Used | Initial Conc (ng/mL) | Initial Volume (mL) | Solution Made | Final Conc (ng/mL) | Final Volume (mL) | Makeup |
|---|---|---|---|---|---|---|
| Stock | 1,000,000 | 0.10 | IMD | 10,000 | 10 | 9.90 |
| IMD | 10,000 | 0.10 | STD 9 | 100 | 10 | 9.90 |
| IMD | 10,000 | 0.08 | STD 8 | 80 | 10 | 9.92 |
| IMD | 10,000 | 0.04 | STD 7 | 40 | 10 | 9.96 |
| IMD | 10,000 | 0.02 | STD 6 | 20 | 10 | 9.98 |
| STD 9 | 100 | 1.00 | STD 5 | 10 | 10 | 9.00 |

TABLE 6-continued

| Solution Used | Initial Conc (ng/mL) | Initial Volume (mL) | Solution Made | Final Conc (ng/mL) | Final Volume (mL) | Makeup |
|---|---|---|---|---|---|---|
| STD 7 | 40 | 1.00 | STD 4 | 4 | 10 | 9.00 |
| STD 6 | 20 | 1.00 | STD 3 | 2 | 10 | 9.00 |
| STD 5 | 10 | 1.00 | STD 2 | 1 | 10 | 9.00 |
| STD 4 | 4 | 1.25 | STD 1 | 0.5 | 10 | 8.75 |
| IMD | 10,000 | 0.075 | HQC | 75 | 10 | 9.925 |
| HQC | 75 | 2.0 | MQC | 15 | 10 | 8.00 |
| MQC | 15 | 1.0 | LQC | 1.5 | 10 | 9.00 |

2. Preparation of $^{13}C_3$-Acrylamide Internal Standard (ISTD) Solution.

2.1. ~1.00 mg/mL Internal Standard Solution $^{13}C_3$-Acrylamide (ISTD Stock):

Prepare a 1.00 mg/mL Stock Solution of compound.

Typical Preparation: Weigh approximately 5 to 10 mg of compound in to Scintillation Vial and record the weight. Add calculated volume of water determined in Equation 1 to the vial. Mix well. An ultrasonic cleaner may be used to assist dissolving the compound. Store at 4° C. until use.

2.2. ~10,000 ng/mL Internal Standard Intermediate Solution (ISTD IMD):

Prepare a 10,000 ng/mL Internal Standard Solution (W-ISTD) of $^{13}C_3$-Acrylamide by diluting 0.1 mL of the Stock Internal Standard Solution (2.1) with 9.9 mL of water. Mix well. Store at 4° C. until use.

2.3. ~100 ng/mL Working Internal Standard Solution (W-ISTD):

Prepare a ~100 ng/mL Working Internal Standard Solution (W-ISTD) of $^{13}C_3$-Acrylamide by diluting 0.1 mL of Internal Standard Intermediate Solution (2.2) with 9.9 mL of water. Mix well. Store at 4° C. until use.

4. Batch Preparation: A study batch includes bracketing calibration standards, quality control (QC) samples, blanks, and study specimens. At least one zero standard is placed after a high standard, high QC or suspected high study specimen.

4.1. Original Samples and Matrix Blank: Weigh approximately 1 gram of an article of manufacture into a 50 mL polypropylene centrifuge tube and 20 mL of water is added. Vortex for approximately 10 minutes. For paper towel, weigh 1 sheet of paper towel into a suitable container and 100 mL of water is added. Vortex for approximately 10 minutes. For polymer solution, weigh approximately 10 mg of polymer solution and dilute it with water to an appropriate concentration.

4.2. Working Internal Standard: Add 0.050 mL of the Working Internal Standard solution (W-ISTD as prepared in Section 2.2) into each well of a 96-well plate except for the Reagent Blank.

4.3. Reagent Blank: Add 0.250 mL of water to all designated wells for reagent blanks and STD 0.

4.4. STD Samples. Add 0.200 mL of each calibration standard solution (STD 1-STD 9 prepared in Section 1.2) to its designated wells.

4.5. QC Samples. Add 0.200 mL of each quality control calibration solution (LQC, MQC and HQC prepared in Section 1.2) to its designated wells.

4.6. Samples. Add 0.200 mL of each sample to its designated wells.

4.7. Cover the plate with sealing mat and vortex the plate for approximately 10 seconds.

4.8. Analyze the samples by HPLC-MS/MS.

Analysis by HPLC-MS/MS

Using the instrument parameters listed below in Tables 7-9:

TABLE 7

| HPLC-MS/MS Parameters<br>API 4000 Sciex MS with Shimadzu Pump and Leap Injector | |
|---|---|
| Flow rate | 0.30 mL/min |
| Injection volume | 10 μL* |
| Total Run time | 5 min |
| HPLC Column Temperature | Ambient |
| Pre Clean with Wash 1 | 2 |
| Pre Clean with Wash 2 | 0 |
| Post Clean with Wash 1 | 1 |
| Post Clean with Wash 2 | 1 |
| Valve Clean with Wash 1 | 1 |
| Valve Clean with Wash 2 | 1 |

*The injection volume may be adjusted to optimize the HPLC-MS/MS sensitivity.

TABLE 8

| Gradient | | |
|---|---|---|
| Time | Mobile Phase A (%) | Mobile Phase B (%) |
| 0.0 | 100 | 0 |
| 2.4 | 100 | 0 |
| 2.7 | 0 | 100 |
| 3.5 | 0 | 100 |
| 3.6 | 100 | 0 |
| 5.0 | 100 | 0 |

TABLE 9

| Time | Divert Valve |
|---|---|
| 0.0 | To Waste |
| 0.5 | To MS |
| 4.5 | To Waste |

Mass Spectrometer Parameters.

These are typical operating conditions for the Sciex API 4000 mass spectrometer as shown in Table 10 below. These parameters may be adjusted to optimize the response; however, these parameters must not be adjusted during a run, but rather a consistent set of instrument settings/parameters must be used for each run.

TABLE 10

| Mass Spectrometer: | Sciex API 4000 |
|---|---|
| Ionization mode: | Turbo-Ion Spray-ESI |
| Polarity: | Positive |
| Turbo Temp: | 650° C. |
| CUR: | 30 |
| GS 1: | 75 |
| GS 2: | 75 |
| IS: | 3800 |
| CAD: | 12 |
| EP: | 10 |
| CXP: | 10 |
| Dwell: | 80 |

TABLE 11

| Ions used in MRM mode | | | | |
|---|---|---|---|---|
| Compound | Precursor Ion (m/z) | Product Ion (m/z) | DP | CE |
| Acrylamide | 71.9 | 55.1 | 36 | 17 |
| $^{13}C_3$-Acrylamide | 74.9 | 58.1 | 41 | 17 |

The molecular ions listed in Table 11 above may vary by ±0.2 m/z depending upon instrument calibration and optimization.

Regression Analysis:

A weighted ($1/x^2$) quadratic regression analysis is performed in Analyst for the observed signal (defined here as the peak area ratio of the analyte to its internal standard) as a function of the analyte mass.

System Suitability Criteria:

Visual inspection will ensure no significant peaks (<20% of the response of the lowest standard) at the retention time of the analyte.

That adequate retention and peak shape is obtained for the analyte and that following the high standard there is not significant carry over in a STD 0 (<20% of the response for lowest standard) for each analyte.

Standard Curve Acceptance Criteria:

The curve contains at least 5 unique non-zero standards and at least 75% of the standards analyzed must meet the accuracy (% RE) criteria.

% RE of each back calculated standard mass is ±15% (±20% for low standard)

QC Acceptance Criteria:

At least 67% of the total number of QC's run, and at least 50% of the QC's at each mass level (LQC, MQC & HQC), must meet the following accuracy acceptance criteria.

The % RE must be less than or equal ±15% at each QC level.

Bulk Viscosity Test Method

The purpose of this bulk viscosity test is to measure the viscosity of emulsions, such as dewatered emulsions, themselves.

Equipment:

Brookfield viscometer model LVT (or LVF) or equivalent;

Constant temperature bath at 25° C.;

250 mL capped bottles

Thermometer

Procedure:

Place 250 mL of the neat emulsion in a clean, dry bottle and close with cap.

Place bottle in a constant temperature bath set at 25° C. and allow the sample to equilibrate at 25° C. Immediately thoroughly mix the sample and then immediately, while sample is at 25° C., test the sample.

Measure the viscosity with the Brookfield viscometer using the suitable spindle at 30 rpm as set forth below in Table 12.

Let the spindle turn until the index is providing a stable reading (about 30 seconds).

Viscosity(in cps)=value×appropriate factor

TABLE 12

| Spindle speed 30 rpm | LV1 X 2 | LV2 X 10 | LV3 X 40 |
|---|---|---|---|

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A dry wet-laid paper towel comprising;

a) less than 20% by weight moisture as measured according to the Moisture Content Test Method;

b) a plurality of water-soluble polymer particles wherein the water-soluble polymer particles comprise a soil adsorbing polymer;

c) a hydrocarbon fluid comprising an ester; and d) a hydrocarbon fluid comprising white mineral oil;

such that the dry wet-laid paper towel adsorbs soil during use, wherein the hydrocarbon fluids exhibit a VOC content of less than 60% as measured according to the VOC Test Method.

2. The dry wet-laid paper towel according to claim 1 wherein the soil adsorbing polymer comprises a monomeric unit derived from an acrylamide compound.

3. The dry wet-laid paper towel according to claim 1 wherein the soil adsorbing polymer comprises a monomeric unit derived from acrylic acid.

4. The dry wet-laid paper towel according to claim 1 wherein the soil adsorbing polymer exhibits a net negative charge density as measured according to the Charge Density Test Method.

5. The dry wet-laid paper towel according to claim 1 wherein the soil adsorbing polymer exhibits a UL Viscosity of from about 1 to about 6 cP as measured according to the Bulk Viscosity Test Method.

6. The dry wet-laid paper towel according to claim 1 wherein at least a portion of the water-soluble polymer particles are present on a surface of the dry wet-laid paper towel.

7. The dry wet-laid paper towel according to claim 1 wherein the dry wet-laid paper towel comprises greater than 0.005% by weight of the dry wet-laid paper towel of the water-soluble polymer particles.

8. The dry wet-laid paper towel according to claim 1 wherein the ester comprises octyl stearate.

9. The dry wet-laid paper towel according to claim 1 wherein the dry wet-laid paper towel comprises greater than 0.005% by weight of the dry wet-laid paper towel of the hydrocarbon fluids.

10. The dry wet-laid paper towel according to claim 1 wherein the dry wet-laid paper towel further comprises from 0% to less than 10% by weight of the dry wet-laid paper towel of water.

11. The dry wet-laid paper towel according to claim 1 wherein the dry wet-laid paper towel comprises less than 350 ppm of residual acrylamide monomer as measured according to the Acrylamide Monomer Test Method.

12. The dry wet-laid paper towel according to claim 1 wherein the dry wet-laid paper towel exhibits an initial Average Soil Adsorption Value of greater than 90 mg/g dry wet-laid paper towel as measured according to the Soil Adsorption Test Method.

13. The dry wet-laid paper towel according to claim 12 wherein the dry wet-laid paper towel exhibits an Average Soil Adsorption Value of greater than 90 mg/g dry wet-laid paper towel as measured according to the Soil Adsorption Test Method after being subjected to the Stress Aging Procedure.

14. The dry wet-laid paper towel according to claim 1 wherein the dry wet-laid paper towel exhibits an initial Average Mirror Densitometer Value of greater than −0.46 as measured according to the Mirror Cleaning Test Method.

15. The dry wet-laid paper towel according to claim 14 wherein the dry wet-laid paper towel exhibits an Average Mirror Densitometer Value of greater than −0.46 as measured according to the Mirror Cleaning Test Method after being subjected to Stress Aging Procedure.

16. A process for making a dry wet-laid paper towel according to claim 1 wherein the process comprises the step of contacting a dry wet-laid paper towel with a dewatered emulsion comprising:

1) a continuous phase comprising a hydrocarbon fluid comprising an ester and a hydrocarbon fluid comprising white mineral oil, wherein the hydrocarbon fluids exhibit a VOC content of less than 60% as measured according to the VOC Test Method and
2) a dispersed phase comprising a plurality of water-soluble polymer particles such that the dry wet-laid paper towel is formed.

* * * * *